US008818222B2

(12) United States Patent
Tamaki

(10) Patent No.: US 8,818,222 B2
(45) Date of Patent: Aug. 26, 2014

(54) IMAGE HEATING APPARATUS

(75) Inventor: Masayuki Tamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/158,805

(22) Filed: Jun. 13, 2011

(65) Prior Publication Data

US 2011/0305473 A1 Dec. 15, 2011

(30) Foreign Application Priority Data

Jun. 15, 2010 (JP) ..... 2010-136540

(51) Int. Cl.
*G03G 15/20* (2006.01)

(52) U.S. Cl.
USPC ..... 399/67; 399/329

(58) Field of Classification Search
USPC ..... 399/47, 122, 126, 328, 329, 320, 67
See application file for complete search history.

(56) References Cited

U.S. PATENT DOCUMENTS

| | | | | |
|---|---|---|---|---|
| 5,307,122 | A * | 4/1994 | Ohno et al. | 399/174 |
| 6,456,819 | B1 | 9/2002 | Abe et al. | |
| 7,010,256 | B2 | 3/2006 | Usui et al. | |
| 2005/0105941 | A1 | 5/2005 | Usui et al. | |
| 2010/0183964 | A1 * | 7/2010 | Yoshida et al. | 430/107.1 |

FOREIGN PATENT DOCUMENTS

| | | | |
|---|---|---|---|
| JP | 04-44075 | | 2/1992 |
| JP | 2001-42670 | | 2/2001 |
| JP | 2004-184518 | | 7/2004 |
| JP | 2007047674 | A * | 2/2007 |
| JP | 2008256918 | A * | 10/2008 |

OTHER PUBLICATIONS

Machine translation of Watanabe et al.*
Machine translation of Moriya, JP 2007-047674.*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image heating apparatus includes a rotatable belt member for heating an image on a recording material; a rotatable member pressing against said belt member; a nip forming member, provided inside said belt member, for cooperating with said rotatable member to form a nip for nipping and feeding the recording material; a projection provided on a side of said nip forming member near the nip and projecting toward the nip; and an executing portion for executing a first image heating mode operation in which an image formed on the recording material having a first thickness with said projection projected into a nip region and a second image heating mode operation in which an image formed on the recording material having a second thickness which is smaller than the first thickness with said projection is outside the nip region.

6 Claims, 15 Drawing Sheets

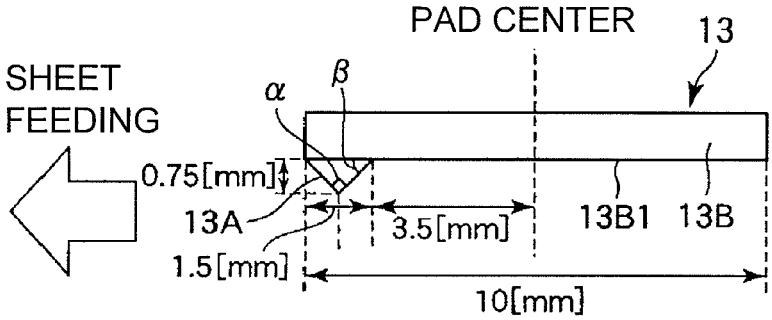
(a)
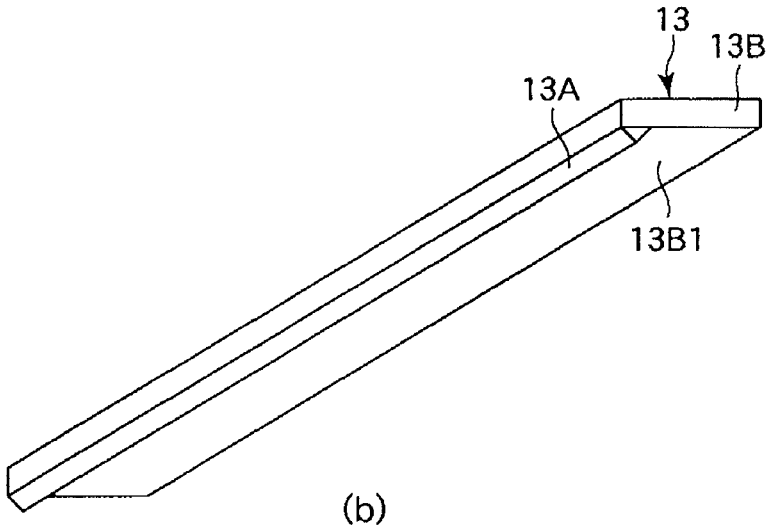
(b)
Fig. 3

DIAMETER OF TONER PARTICLE $L$ [μm]

VOLUME OF TONER $V = \frac{4}{3}\pi\left(\frac{L}{2}\right)^3$ [μm³]

PROJECTION AREA OF TONER $Sa = \pi\left(\frac{L}{2}\right)^2$ [μm²]

UNIT AREA INCLUDING ONE TONER PARTICLE (RHOMBIC AREA) $Sb = \frac{\sqrt{3}}{2}L^2$ [μm²]

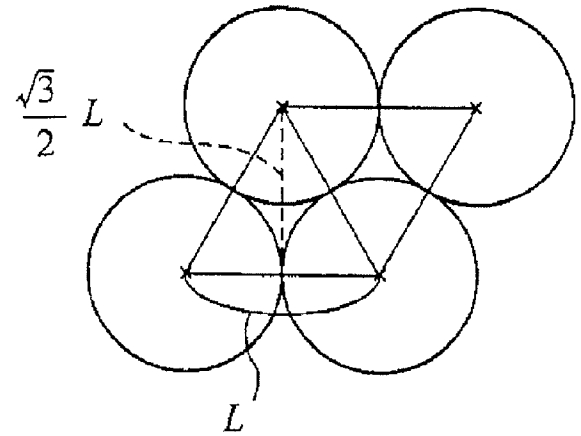

AMOUNT OF ONE LAYER (MONOCHROME) OF MOST DENSE TONER PARTICLES (VOL./UNIT AREA=AVE. HIGHT)

$$H = \frac{V}{Sb} = \frac{4}{3}\pi\left(\frac{L}{2}\right)^3 \cdot \frac{2}{\sqrt{3}\,L^2} = \frac{\pi L}{3\sqrt{3}} \quad [\mu m]$$

Fig. 16

IMAGE HEATING APPARATUS

FIELD OF THE INVENTION AND RELATED ART

The present invention relates to an image heating apparatus for heating the image on recording medium.

There are various image heating apparatuses. For example, a fixing device for fixing an unfixed image on recording medium to the recording medium, an apparatus for heating a fixed image on recording medium to increase the image in glossiness, and the like can be listed as an image heating apparatus.

There are a variety of image heating apparatuses, which have been known as a fixing device employed by an electrophotographic image forming apparatus to fix an unfixed toner image to recording medium. One of the fixing devices has been known as a fixing device of the heat roller type, the fixing member of which has an elastic roller. A fixing device of the heat roller type has two heating rollers, that is, a fixation roller and a pressure roller, and is structured so that the two heating rollers form a fixation nip by being pressed upon each other. In an operation for fixing an unfixed toner image on recording medium, the two heating rollers are kept at a preset level in temperature, and recording medium on which an unfixed toner image is present is moved through the fixation nip. As the recording medium on which an unfixed toner image is present is moved through the fixation nip of the fixing device, heat and pressure are applied to the unfixed toner image on the recording medium so that the toner image becomes fixed to the recording medium; the unfixed toner image is turned into a permanent image. There have also been known film (belt)-based fixing devices (Japanese Laid-open Patent Application H04-44075). In the case of some film (belt)-based fixing devices, the film (endless belt) is externally heated, whereas in the case of the other, which are referred to as a fixing device of the electromagnetic induction type (Japanese Laid-open Patent Application 2001-42670), the film (endless belt) is internally (electromagnetically) heated. Image fixing devices of the electromagnetic induction type have also been in practical use.

In recent years, the wave of colorization has been spreading in the field of image forming apparatuses, such as printers and copying machines. A color image forming apparatus is used for outputting a photographic image. Therefore, it is required to be capable of outputting a glossy image.

While the wave of colorization has been spreading in the field of image forming apparatuses, the following fixing device, has been disclosed in Japanese Laid-open Patent Application 2004-184518, which is excellent in terms of energy efficiency and can yield a permanent image which is high and uniform in glossiness. More specifically, this fixing device has a fixation film (endless belt) and a pressure roller. More concretely, the fixing device has also a pad on which the fixation film slides. The pad is placed within the loop which the fixation film forms. It is kept pressed against the pressure roller, with the presence of the fixation film between the pad and pressure roller, creating thereby a fixation nip between the fixation film and pressure roller. Further, the pad is provided with a ridge, the position of which relative to the pad is such that as the pad is pressed against the pressure roller (fixation film), it will be on the downstream side of the center of the fixation nip in terms of the direction in which recording medium conveyed through the fixation nip. Thus, the pressure peak of the pressure distribution in the fixation nip is on the downstream side of the center of the fixation nip.

However, the fixing device disclosed in Japanese Laid-open Patent Application 2004-184518 has the following problems when thin paper or film, which is low in rigidity, is used as recording medium. That is, as a sheet of thin paper or film is sent into the fixation nip, it is possible that the sheet is adhered to the fixation film by the thermally melted toner. That is, it is possible that the so-called "wrapping jam" or the phenomenon that a sheet of recording medium wraps around the fixation film will occur.

It seems to be reasonable to think that the primary cause of the above described jam is as follows: That is, as the toner softens between the fixation film and recording medium, it becomes adhesive, being therefore likely to cause the recording medium to adhere to the surface of the fixation film. The secondary cause of the above describe jam seems to be as follows: That is, the ridge of the pad is on the downstream side of the center of the fixation nip in terms of the recording medium conveyance direction, and presses the recording medium downward (toward pressure roller). Thus, as the recording medium comes out of the fixation nip, its leading end portion is made to bend upward (toward fixation film) by the ridge, impeding thereby the recording medium from separating from the fixation film. This is why the fixing device disclosed in the abovementioned patent application is likely to cause a sheet of thin paper or film to adhere to, and wrap around, the fixation film.

SUMMARY OF THE INVENTION

Thus, the primary object of the present invention is to provide an image heating device which is superior to any of image heating devices in accordance with the prior art, not only in terms of recording medium separation, but also, in terms of glossiness level.

According to an aspect of the present invention, there is provided an image heating apparatus comprising a rotatable belt member for heating an image on a recording material; a rotatable member pressing against said belt member; a nip forming member, provided inside said belt member, for cooperating with said rotatable member to form a nip for nipping and feeding the recording material; a projection provided on a side of said nip forming member near the nip and projecting toward the nip; and an executing portion for executing a first image heating mode operation in which an image formed on the recording material having a first thickness with said projection projected into a nip region and a second image heating mode operation in which an image formed on the recording material having a second thickness which is smaller than the first thickness with said projection is outside the nip region.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3(*a*) is a schematic sectional view of an example of the pressure pad in the first preferred embodiment of the present invention, and FIG. 3(*b*) is a perspective view of the pressure pad.

FIG. 16 is a drawing for describing the various parameters which affect the performance of the fixing device in accordance with the present invention, and shows their relationship when the toner alignment on recording medium is idealistic.

DESCRIPTION OF THE PREFERRED EMBODIMENTS

Hereinafter, the present invention is described in detail with reference to the image heating device in accordance with the present invention and the appended drawings.

[Embodiment 1]

1. Image Forming Apparatus

Figure 1:
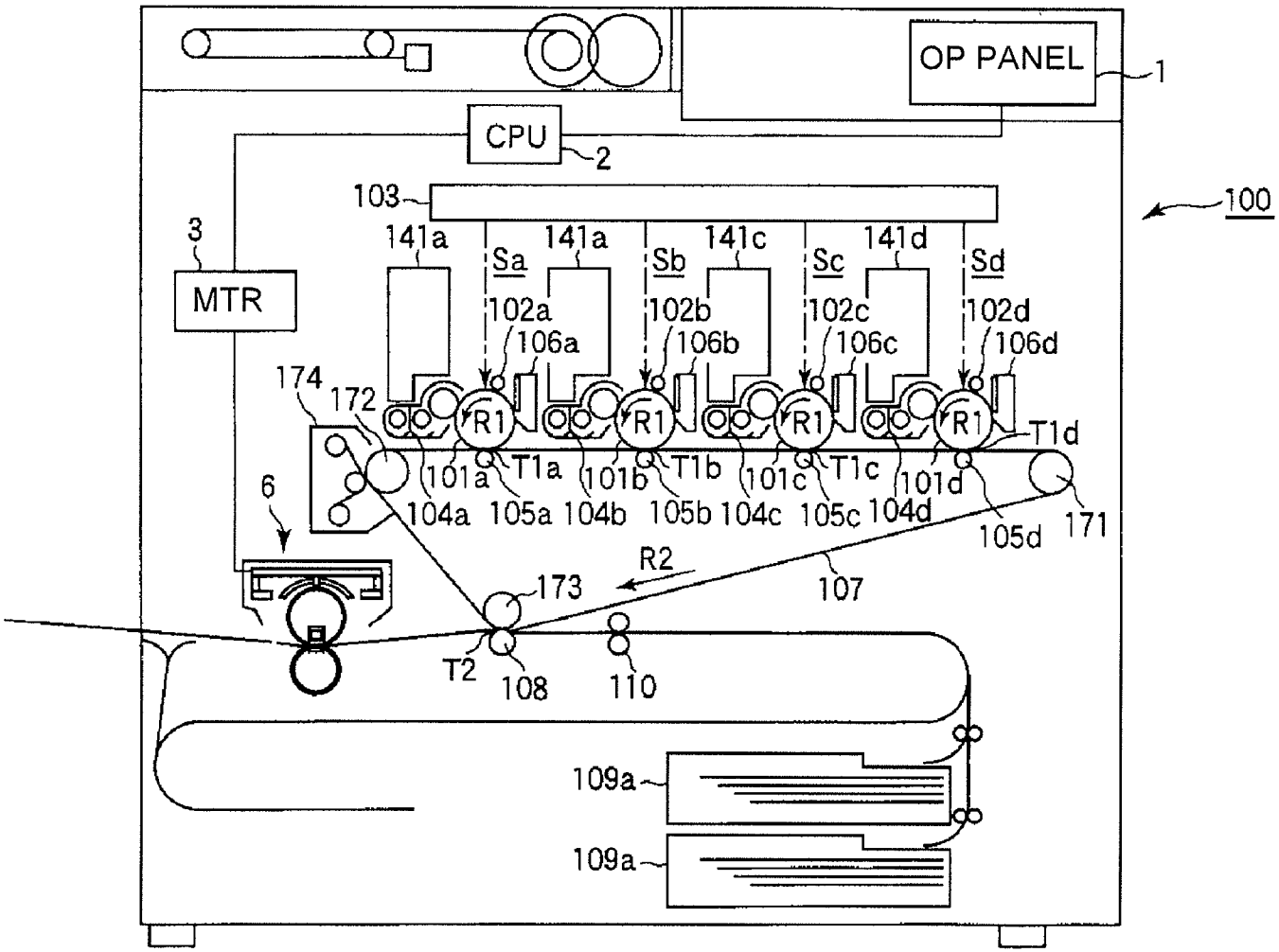
FIG. 1 is a schematic sectional view of the image forming apparatus which employs the fixing device in the first preferred embodiment of the present invention, and shows the general structure of the image forming apparatus.

FIG. 1 is a schematic sectional view of the image forming apparatus 100 which employs the fixing device in the first preferred embodiment of the present invention. This image forming apparatus 100 is a laser beam printer capable of forming a full-color image with the uses of an electrophotographic image forming method. It is of the intermediary transfer type, and is also of the tandem type.

The image forming apparatus 100 has multiple image forming stations, more specifically, the first, second, third, and fourth image forming stations Sa, Sb, Sc, and Sd, respectively. In this embodiment, the image forming stations Sa, Sb, Sc, and Sd are practically the same in structure and operation, although they are different in the color of the toner they use. Therefore, they are described together. That is, the suffixes of the referential codes given to identify their structural components and the like will not be shown unless necessary to show the difference among the multiple image forming stations.

The image forming station S has a photosensitive drum 101, which is an electrophotographic photosensitive member (photosensitive member) as an image bearing member. It is in the form of a cylindrical drum. It is rotated in the direction (counterclockwise direction) indicated by an arrow mark R1 in FIG. 1. The image forming station S has also the following means, which are in the adjacencies of the peripheral surface of the photosensitive drum 101. That is, it has: a charge roller 102, which is a charging member (charging device of contact type) as a charging means; a developing device 104 as a developing means; a first transfer roller 105 as the first transferring member (charging device of contact type) as a first transferring means; and a drum cleaner 106 as a means for cleaning the photosensitive member.

The image forming apparatus 100 has also an exposing device 103 as an exposing means for exposing each of the photosensitive drums 101*a*-101*d*. The exposing device 103 is above the photosensitive drums 101*a*-101*d*. It has a light source, a polygonal mirror, etc.

The image forming apparatus 100 has also an intermediary transfer belt 107 as an intermediary transfer member. The intermediary transfer belt 107 is an endless belt, and is positioned so that it opposes all of the photosensitive drums 101*a*-101*d* of the image forming stations Sa-Sd, respectively. The intermediary transfer belt 107 is suspended and kept stretched by a driver roller 171, a tension roller 172, and a second transfer roller 173. As rotational driving force is transmitted to the driver roller 171, the intermediary transfer belt 107 is rotated (circularly moved) by the rotation of the driver roller 171 in the direction (clockwise direction) indicated by an arrow mark R2. The first transfer rollers 105*a*-105*d* are on the inward side of the loop which the intermediary transfer belt 107 forms. They form first transfer stations T1*a*, T1*b*, T1*c*, and T1*d*, where the intermediary transfer belt 107 is placed in contact with the photosensitive drums 101*a*-101*d* by being pressed against the photosensitive drums 101*a*-101*d* by the first transfer rollers 105*a*-105*d*, respectively. The image forming apparatus 100 has also a second transfer roller 108 and a transfer belt backing roller 173. The second transfer roller 108 is a second transferring member (charging device of contact type) which is a second transferring means. It is on the outward side of the loop which the intermediary transfer belt 107 forms. It is positioned in contact with the outward surface of the intermediary transfer belt 107 in such a manner that it is pressed against the transfer belt backing roller 173, with the presence of the intermediary transfer belt 107 between the two rollers 108 and 173, forming thereby the second transfer station T2 where the intermediary transfer belt 107 is in contact with the second transfer roller 108.

Next, the image forming operation of this image forming apparatus 100 is described with reference to the formation of a full-color image, for example. First, the photosensitive drums 101*a*-101*d* are uniformly charged across their peripheral surface by the charging rollers 102*a*-102*d*, in the image forming stations Sa-Sd, respectively. Then, the charge portion of the peripheral surface of the photosensitive drum 101 is exposed by the exposing device 103. More specifically, the exposing device 103 projects a beam of laser light while modulating the beam of laser light with the image formation signals obtained by separating the optical image of the image to be formed into four monochromatic images of primary colors, one for one. The beam of laser light is reflected by the rotating polygonal mirror of the exposing device 103, in such a manner that it scans the peripheral surface of the photosensitive drum 101 while being focused on the generatrix of the photosensitive drum 101 by the f-θ lens of the exposing device 103. As a result, an electrostatic latent image is formed on the peripheral surface of each of the photosensitive drums 101*a*-101*d*. Then, the electrostatic latent images on the photosensitive drums 101*a*-101*d* are developed by the developing devices 104*a*-104*d* into four visible images, that is, four monochromatic images formed of toners which correspond in color to the aforementioned primary colors, one for one.

The developing devices 104*a*-104*d* contain yellow, magenta, cyan, and black developers, respectively, which are two-component developers. Basically, each developer is a mixture of nonmagnetic toner particles (toner) and magnetic carrier particles (carrier). The two-component developer is circulated in the developing devices 104*a*-104*d*. Incidentally, in order to compensate for the consumption of the toner in the developer by image formation, the developing devices 104*a* and 104*d* are supplied as necessary with a fresh supply of toner by toner supplying devices 141*a*-141*d*, respectively.

As the image outputting operation is started, it is first confirmed whether or not the intermediary transfer belt 107 is in a preset position. As soon as it is confirmed that the intermediary transfer belt 107 is in the preset position, the driver roller 171 is rotated to circularly move the intermediary transfer belt 107. At the same time as the driver roller 171 begins to be rotated, an image writing start signal is sent in, and then, a monochromatic image begins to be formed on the peripheral surface of the photosensitive drum 101*a*, with a timing set with reference to the image writing start signal, in the first image forming station Sa.

The toner image formed on the peripheral surface of the photosensitive drum 101*a* in the first image forming station Sa is transferred (first transfer) onto the intermediary transfer belt 107 by providing the first transfer roller 105*a* with an electric field or electric charge, in the first transfer station 1*a*. This toner image, or the toner image of the first primary color, is conveyed to the first transfer station T1*b* of the second image forming station Sb.

Thereafter, the monochromatic toner images, different in color (primary color), formed in the second to fourth image forming stations Sb-Sd, one for one, as in the same manner as the monochromatic toner image of the first primary color is formed in the first image forming station Sa, are transferred (first transfer) in layers onto the intermediary transfer belt 107. Then, the portion of the intermediary transfer belt 107, onto which the four monochromatic toner images, different in color, have just been transferred in layers, is conveyed to the second transfer station T2.

Meanwhile, one of the sheets P of recording medium in recording medium cassettes 109*a* or 109*b* is conveyed from the cassette 109*a* or 109*b* to the second transfer station T2 by way of multiple pairs of recording medium conveyance rollers and a pair of registration rollers 110, and then, is conveyed through the second transfer station T2. As the sheet P of recording medium is conveyed through the second transfer station T2, the toner images on the intermediary transfer belt 107 are transferred together (second transfer) by the provision of an electric field or an electric charge by the second transfer roller 108.

As the sheet P of recording medium, on which the unfixed monochromatic toner images are present, comes out of the second transfer station T2, it is conveyed to the fixing device 6 as an image heating device. In the fixing device 6, heat and pressure are applied to the unfixed toner images on the sheet P of recording medium. Thus, the unfixed toner images become fixed to the sheet P of recording medium. The fixing device 6 is described later in detail.

Thereafter, the sheet P of recording medium is discharged from the image forming apparatus 100. As for the toner particles remaining on the peripheral surface of the photosensitive drum 101 after the first transfer, they are recovered by the drum cleaner 106. The toner particles remaining on the intermediary transfer belt 107 after the second transfer are recovered by a belt cleaner 174 as an intermediary transfer belt cleaning means.

In this embodiment, the image forming stations Sa-Sd, intermediary transfer belt 107, second transfer roller 108, etc., make up the image forming means for forming toner images on the sheet P of recording medium.

Also in this embodiment, the toner is 5.5 μm in average particle diameter, and 1.1 g/cm$^2$ in specific gravity. Further, the theoretical amount by which toner is to be transferred (adhered) to the sheet P of recording medium to form a solid monochromatic portion of the image to be formed is 0.5 mg/cm$^2$, whereas the maximum amount by which toner is transferred (adhered) to the sheet P of recording medium is 1.0 mg/cm$^2$. The "theoretical amount by which toner is to be transferred (adhered) to the sheet P of recording medium to form a solid monochromatic portion of the image to be formed" means the amount by which toner is transferred (adhered) to the sheet P of recording medium (peripheral surface of photosensitive drum 101) per unit area when an electrostatic latent image, which is highest in terms of density, is developed by monochromatic toner. Further, the "average particle diameter of toner" means the weight average particle diameter measured with the use of the following method. First, 100-150 ml of water solution of electrolyte (roughly 1% water solution of NaCl, for example), which contains several milliliters of surfactant (preferably, alkyl benzene sodium sulfonate) is prepared. Then, 2-20 mg of toner is added to the water solution, and is dispersed several minutes with the use of an ultrasonic dispersing device. Then, the weight average particle diameter of the toner is obtained by measuring this solution with the use of a Coulter counter TA-11 (product of Beckman-Coulter Co., Ltd.).

2. Fixing Device

Figure 2:
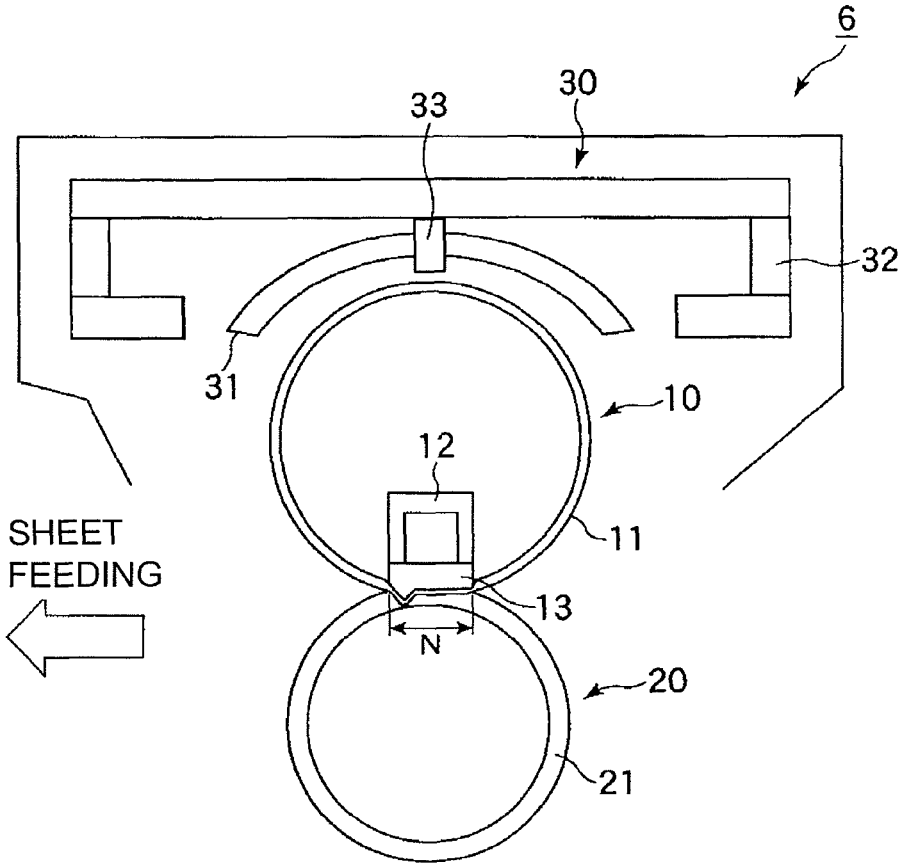
FIG. 2 is a schematic sectional view of the fixing device in the first preferred embodiment of the present invention.

Next, the fixing device 6 is described. FIG. 2 is a schematic sectional view of the fixing device 6 in this embodiment.

In this embodiment, the fixing device 6 is a fixing apparatus of the so-called film heating type. That is, the fixing device 6 has a fixation film 11 which is an endless belt and is circularly movable (circularly movable heating member). It has also a pressure roller 21 and a pressure pad 13. The pressure roller 21 is a rotatable member (pressure applying rotatable member) and is kept pressed against the pressure pad 13 to form a nip N (fixation nip) through which the sheet P of recording medium is conveyed while remaining sandwiched by the pressure roller 21 and pressure pad 13. The pressure pad 13 is one of the nip forming members for forming the fixation nip N, and is on the inward side of the loop which the fixation film 11 forms. Further, the fixing device 6 has an IH coil 31, a side core 32, a center core 33, a pressure pad supporting member 12, etc. The fixation film 11, pressure pad supporting member 12, pressure pad 13, etc., make up the heating unit 10. The pressure roller 21 makes up a pressure unit 20. The means for heating the fixation film 11 is made up of the IH coil 31, side core 32, center core 33, etc.

The fixation film 11 has three layers, which are a substrate layer, an elastic layer, and a parting layer, listing from the inward side of the fixation film 11. In this embodiment, the fixation film 11 is 30 mm in diameter. The substrate layer is a heat generating metallic layer, in which eddy current is generated by the alternating magnetic field generated by the IH coil 31. It is formed of iron, stainless steel, nickel, or the like substance. It is desired to be no less than 10 μm and no more than 100 μm in thickness. If the substrate layer of the fixation film 11 is no more than 10 μm in thickness, the fixation film 11 is inferior in durability, and also, it can hardly absorb the electromagnetic energy, rendering therefore the fixation film 11 inferior in efficiency. On the other hand, if it is no less than 100 μm in thickness, it makes the fixation film 11 excessively rigid, that is, unlikely to easily bend. Thus, using a fixation film (11), the substrate layer of which is no less than 100 μm, is unrealistic, since the fixation film 11 has to be circularly moved. The elastic layer is formed of a substance which is heat resistant, excellent in thermal conductivity, and elastic. The elastic layer is desired to be no less than 10 μm and no more than 500 μm in thickness. As the material for the parting layer, a substance, such as fluorinated resin (PTFE, PFA, FEP, etc.) silicone resin, fluorinated rubber, silicone rubber, which is superior in parting properties and heat resistance, is desired. The thickness of the parting layer is desired to be no less than 1 μm and no more than 100 μm. If the parting layer is no less than 1 μm in thickness, it is likely to allow toner to offset from the sheet P of recording medium onto the fixation film 11. On the other hand, if it is no less than 100 μm in thickness, it cannot fully transfer the heat generated in the heat generation layer, to the sheet P of recording medium and the toner thereon, and therefore, is likely to cause the fixing device 6 to fail to properly fix the toner images.

The pressure roller 21 comprises a metallic core and an elastic layer. The elastic layer which is formed of silicone rubber or the like is for providing the pressure roller 21 with a certain amount of softness (elasticity). The elastic layer of pressure roller 21 may be coated with fluorinated resin such as PTFE, PFA, and FEP in order to improve the pressure roller 21 in surface properties. The pressure roller 21 is rotatably supported by its lengthwise ends, in terms of the direction parallel to the axial line of the metallic core, by the chassis (unshown) of the fixing device 6, with a pair of bearings positioned between the lengthwise ends of the metallic core and the left and right walls (metallic plates) of the chassis. In this embodiment, the pressure roller 21 is 30 mm in diameter.

The pressure roller 21 and pressure pad 13 are kept pressed against each other with the presence of the fixation film 11 between the roller 21 and pad 13, forming thereby the fixation nip N (compression nip) between the fixation film 11 and pressure pad 13. While the sheet P of recording medium, on which the unfixed toner images are present, is conveyed through the fixation nip N while remaining pinched by the pressure roller 21 and fixation film 11, the toner images are heated and compressed. Consequently, the toner images become fixed to the sheet P.

The pressure pad 13, which is one of the nip forming members, is formed of a substance which is heat resistant and is rigid enough to compress the fixation film 11 against the pressure roller 21. In this embodiment, the pressure pad 13 is formed of heat resistant engineering plastic. Further, the surface of the pressure pad 13, which faces the metallic substrate of the fixation film, is covered with a slippery sheet, such as a glass sheet coated with PTFE, in order to make the surface slipperier. Incidentally, it may be simply coated with lubricant such as silicon oil.

Figure 13:
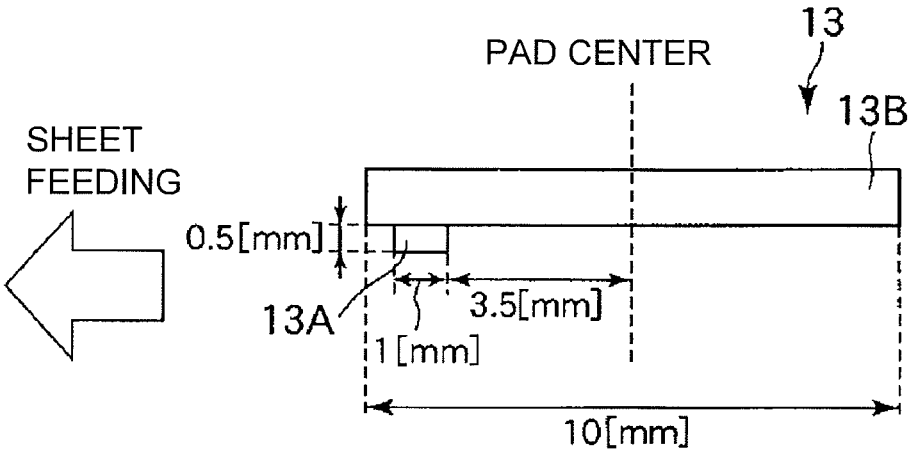
FIG. 13 is a schematic sectional view of an example of the pressure pad which is different from the pressure pads shown in FIGS. 3 and 12.

FIG. 3(*a*) is a schematic sectional view of the pressure pad 13 in this embodiment. FIG. 13(*b*) is a perspective view of the pressure pad 13 in this embodiment. The pressure pad 13 comprises a base 13B and a ridge 13A. The base 13B is the lengthwise direction of which is roughly perpendicular to the direction in which the sheet P of recording medium is conveyed. The ridge 13A is on the surface 13B1 (which faces pressure roller 21) of the base 13, on which the fixation film 11 slides as it is circularly moved. The ridge 13A extends in the lengthwise direction of the base 13B, across virtually entire range of the base 13B. The surface 13B1 of the base 13B, on which the fixation film 11 slides, is roughly parallel to the direction in which the sheet P of recording medium is conveyed through the fixation nip N. In this embodiment, it is roughly horizontal. The ridge 13A is triangular in cross section, and is at the downstream edge of the base 13B in terms of the recording medium conveyance direction.

To describe in more detail, in this embodiment, the width of the pressure pad 13, that is, the dimension of the pressure pad 13 in terms of the direction in which the sheet P of recording medium is conveyed, is 10 mm. As for the size and position of the ridge 13A, the distance between the upstream edge of the ridge 13A and the center of the pressure pad 13 in terms of the recording medium conveyance direction is 3.5 mm, whereas the distance between the tip of the ridge 13A and the downstream edge of the base 13B is 1.5 mm. Further, the height of the ridge 13A is 0.75 mm. That is, in this embodiment, the tip of the ridge 13A, which corresponds to the top of the triangular cross section of the ridge 13A, is located 4.25 mm downstream of the center of the pressure pad 13 in terms of the recording medium conveyance direction. The angle a of the tip portion of the ridge 13A is 90 degrees, and the angle β, which is the angle between the upstream lateral surface of the ridge 13A and the surface 13B1 of the base 13B is 45 degrees.

In this embodiment, the ridge 13A is an integral part of the pressure pad 13. However, all that is necessary here is that the ridge 13A is on the surface of the base 13B, which faces the fixation nip N and protrudes toward the fixation nip N. In other words, the ridge 13A may be such a section of the pressure pad 13 that is formed independently from the base 13B of the pressure pad 13 and then, is attached to the surface 13B1 of the base 13B with the use of an optional ridge attaching means such as adhesive.

In this embodiment, the height of the ridge 13A (distance between tip of triangular cross section of ridge 13A and surface 13B1) is set to 0.75 mm to locally increase the fixation nip N in internal pressure. Also in this embodiment, the ridge 13A of the pressure pad 13 is changed in its position relative to the fixation nip N, according to the type of recording medium. This feature of the fixing device 6 is described later in detail.

The pressure pad supporting member 12 is formed of a metallic substance such as stainless steel, aluminum, or the like. It has the function of keeping the pressure pad 13 pressed against the pressure roller 21 with the presence of the fixation film 11 between the pressure pad 13 and pressure roller 21.

The IH coil 31 is in connection to an exciter circuit (unshown), which is capable of outputting high frequency waves which are 20 kHz-100 kHz in frequency with the use of a switching electric power source.

The side core 32 and center cores 33 are formed of highly magnetic substance such as ferrite. They are in magnetical connection to each other because of the presence of the magnetic field generated by the IH coil 31. Positioning the center core 33 and side cores 32 so that the center of the center core 33 coincides with the center of the IH coil, and also, so that the side cores 32 are in the adjacencies of the lengthwise edges of the HI coil 31, one for one, strengthens the magnetic connection between the center core 33 and side cores 32.

Incidentally, in this embodiment, the IH coil 31 is used as the means to heat the fixation film 11. That is, the fixation film 11 is internally heated. However, the fixation film 11 may be externally heated by placing an external heating member in contact with the fixation film 11. Further, in this embodiment, the unfixed toner images become fixed to the sheet P of recording medium by being placed in contact with the fixation film 1 which is being heated by the IH coil 31 as a heat source. However, the present invention is also applicable to a fixing device, the fixation film of which is heated by a halogen heater as a heat source. The effects of such an application are the same as those obtained by the fixing device 6 in this embodiment.

3. Operation of Fixing Device

The unfixed toner images on the sheet P of recording medium are made up of toner particles. Thus, as the sheet P on which the unfixed images are present is conveyed through the fixation nip N of the fixing device 6, the unfixed toner images are heated and compressed in the fixation nip N, whereby they becomes solidly fixed to the sheet P as the sheet P is conveyed out of the fixing device 6 (fixation nip N).

As alternating electrical current is flowed through the IH coil 31 of the fixing device 6, an alternating magnetic field is generated, which in turn generates eddy current in the metallic substrate layer of the fixation film 11. This eddy current generates heat in the metallic substrate layer. Consequently, the fixation film 11 becomes hot. As the temperature of the fixation film 11 becomes high enough for fixation, the pressure roller 21 is pressed against the pressure pad 13 with the presence of the fixation film 11 between the pressure roller 21 and pressure pad 13, forming thereby the fixation nip N between the pressure roller 21 and fixation film 11. As the pressure roller 21 is rotated, the fixation film 11 is circularly moved by the rotation of the pressure roller 21. Then, as the sheet P of recording medium is conveyed through the fixation nip N of the fixing device 6 while remaining pinched by the fixation film 11 and pressure roller 21, heat and pressure are applied to the toner particles, of which the toner images on the sheet P are formed. Thus, the toner particles, of which the unfixed toner images are formed, solidly adhere to the surface of the sheet P; the toner images become fixed to the sheet P.

In this embodiment, an operator is allowed to select the type and size of the sheet P of recording medium with the use of the control panel 1 of the image forming apparatus 100. Thus, as the operator makes a selection, the ridge 13A of the pressure pad 13 is automatically moved to a preset position according to the selection, before the starting of the actual fixing operation, as will be described later in detail.

Figure 4:
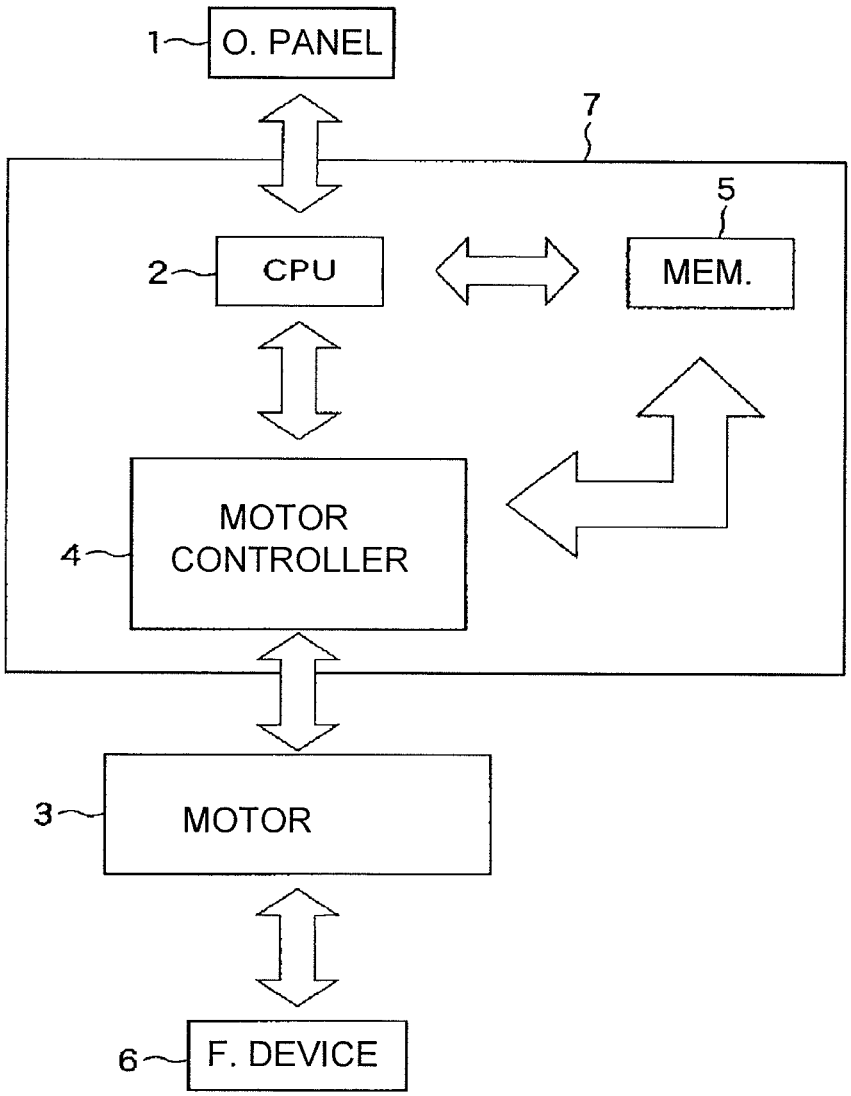
FIG. 4 is a block diagram of the operational sequence for controlling the movement of the heating unit.

Next, the method for changing the position of the heating unit 10 (that is, position of ridge 13A of pressure pad 13) is described. FIG. 4 depicts the control sequence for moving the heating unit 10 which comprises the fixation film 11, pressure pad 13 (which are within fixation film loop), and pressure plate supporting member 12 (which also are within fixation film loop), etc.

First, an operator is to select the type of the recording medium to be used for outputting images, using the control panel 1 of the image forming apparatus 100. Then, the information regarding the selected recording medium type is transferred to a CPU 2 as the controlling means of the control portion 7. The CPU 2 determines whether or not the selected sheet P of recording medium is no less than 80 g/m$^2$ in basis weight, with the reference to the information in a memory 5 as the storage means of the control portion 7. The memory 5 stores the preset relationship between the type and basis weight of recording medium.

Then, the information regarding the decision made by the CPU 2 is transferred to the control portion 4 of the control portion 7, which is for controlling the motor 3 for moving the heating unit 10. Then, the control portion 4 determines whether or not it is necessary for the heating unit 10 of the fixing device 6 to be moved.

If the sheet P of recording medium selected to be used for outputting an image is no less than 80 g/m$^2$ in basis weight, the motor control portion 4 does not activate the motor 3 as the means for moving the heating unit 10, and causes the fixation film 11 and pressure roller 21 to press upon each other. Then, it rotationally moves both the fixation film 11 and pressure roller 21 at 300 mm/s of peripheral velocity (normal mode).

On the other hand, if the sheet P of recording medium selected to be used for outputting an image is no more than 80 g/m$^2$, the motor control portion 4 moves the heating unit 10 by activating the motor 3, in order to change the position of the ridge 13A of the pressure pad 13 relative to the fixation nip N. As the heating unit 10 is moved, the fixation film 11, pressure pad supporting member 12, and pressure pad 13 move together relative to the pressure roller 21 which makes up the pressure unit 20. Then, the CPU 2 causes the fixation film 11 and pressure roller 21 to press upon each other, and begins to rotationally move both the fixation film 11 and pressure roller 21 at 300 mm/s of peripheral velocity (thin paper mode).

As the heating unit 10 is moved, the information regarding the movement of the heating unit 10 is stored in the memory 5, so that the motor control portion 4 can know the current state of the fixing device 6.

When the motor control portion 4 activates the motor 3 after it activated the motor 3 to move the heating unit 10 of the fixing device 6 from the default position of the heating unit 10, it controls the motor 3 in such a manner that the heating unit 10 is moved back into the default position. That is, the motor control portion 4 rotates in reverse by reversing the voltage to be applied to the motor 3.

In this embodiment, the "normal mode (image heating first mode)" is for outputting such an image that is highly glossy and brilliant in color, with the use of a sheet P of recording medium which is no less in basis weight than a referential value (which in this embodiment is 80 g/m$^2$). The "thin paper mode (image heating second mode)" is for reliably delivering a fixed image from the fixing device 6 reliably, that is, without allowing a sheet of recording medium to wrap around the fixation film 11, even when the sheet of recording medium is no more in basis weight than a preset value, being therefore low in rigidity.

Figure 5:
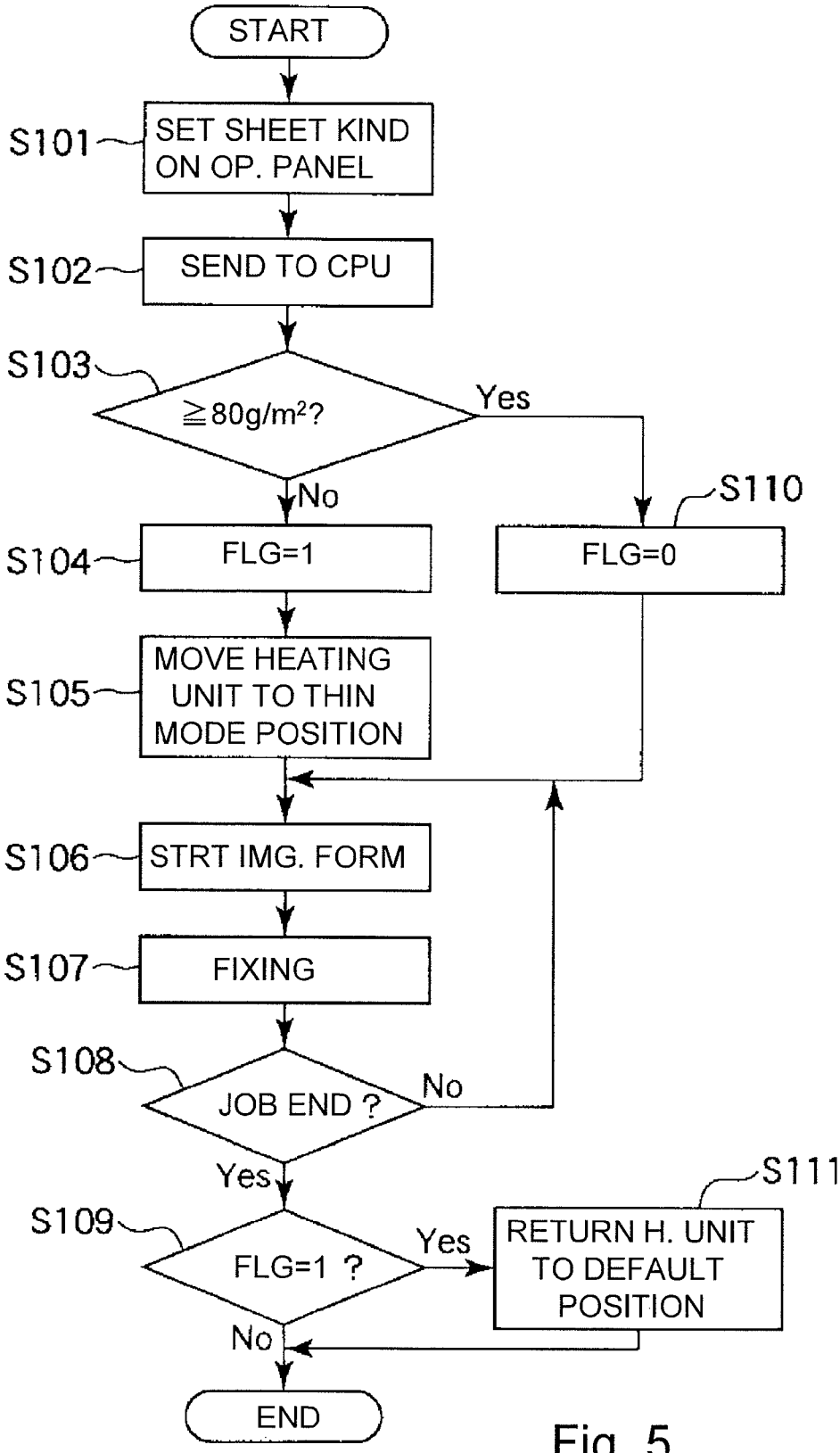
FIG. 5 is an example of the flowchart of the image outputting (forming) operation of the image forming apparatus in accordance with the present invention.

FIG. 5 is a flowchart of the operational sequence for moving the heating unit 10.

As an operator sets the type for the sheet P of recording medium to be used for outputting an image, with the use of the control panel 1 of the image forming apparatus 100 (S101), the information regarding the selected type is transmitted to the CPU 2 of the control portion 7 (S102). Then, based on this information, the CPU 2 determines whether or not the selected sheet P of recording medium is no more than 80 g/cm$^2$ in basis weight (S103). If the CPU 2 determines that the selected sheet P of recording medium is no less than 80 g/m$^2$ in basis weight, it places a flag 0 in the memory 5 (S110). In this case, the heating unit 10 is kept in the default position, which corresponds to the normal mode in which the ridge 13A of the pressure pad 13 is kept within the fixation nip N in terms of the recording medium conveyance direction. Then, image formation is started (S106), and the fixation process is carried out (S107).

On the other hand, if the CPU determines that the selected sheet P of recording medium is no more than 80 g/m$^2$ in basis weight in S103, it places a flag 1 in the memory 5 (S104). Then, the motor control portion 4 moves the heating unit 10 by 1.0 mm in the recording medium conveyance direction by activating the motor 3 in response to the information from the CPU 2 (S105). With this movement of the heating unit 10, the ridge 13A of the pressure pad 13 is moved out of the fixation nip in terms of the recording medium conveyance direction, and is placed in the thin paper position. Then, image formation is started (S106), and then, the resultant unfixed toner images are fixed (S107).

Therefore, if the job (operational sequence started in response to single start signal to form image on two or more sheets of recording medium) has not been completed (S108), the CPU 2 returns to S106, in which images are formed and fixed. On the other hand, if the job has been completed (S108), the CPU 2 determines whether or not the heating unit 10 is in the thin paper mode position, with reference to the flag in the memory 5 (S109). If the CPU 2 determines that the heating unit 10 is not in the thin paper mode position, it ends the image outputting operation. On the other hand, if it determines that the heating unit 10 is in the thin paper mode position, it sends this information to the motor control portion 4. Then, the motor control portion 4 controls the motor 3 according to the information. Thus, the motor 4 moves the heating unit 10 by 1.0 mm in the opposite direction to the recording medium conveyance direction (S111). Thus, the ridge 13A of the pressure pad 13 of the heating unit 10 is moved back into the normal mode position, which is in the fixation nip N in terms of the recording medium conveyance direction. Then, the CPU 2 ends the image outputting operation.

Normally, a sheet P of recording medium (such as sheet of ordinary paper) which is no less than 80 g/m$^2$ in basis weight is thicker and more rigid than a sheet P of recording medium which is no more than 80 g/m$^2$ in basis weight, and therefore, it is unlikely to jam the fixing device 6 by wrapping around the fixation film 11. Therefore, in this embodiment, the "normal mode (image heating first mode)" may be deemed as a mode for outputting a highly glossy and highly brilliant color image with the use of a sheet P of recording medium, the thickness of which is the first thickness, whereas the "thin paper mode (image heating second mode) may be deemed as the mode for ensuring that even if a sheet P paper, film, or the like, the thickness of which is the second thickness which is less than the first thickness, is used as recording medium, a fixed image is delivered from the fixing device 6 without allowing the sheet P to jam the fixing device 6 by wrapping around the fixation film 11. More specifically, if an operator selects the recording medium type with the use of the control panel 1 of the image forming apparatus 100, the CPU 2 determines whether or not the thickness of the sheet P of the selected recording medium is the first thickness, with reference to the information in the memory 5 as the storage means of the control section 7. The memory 5 stores the preset relationship between the recording medium type and recording medium thickness. If the CPU 2 determines that the thickness of the selected sheet P of recording medium is the first one, it controls the fixing device 6 in the same manner as it does when it determines that the sheet P of selected recording medium is no less than 80 g/m$^2$, whereas if it determines that the thickness is the second one, it controls the fixing device 6 in the same manner as it does when it determines that the basis weight of the selected sheet P of recording medium is no more than 80 g/m$^2$, as described above.

As described above, the fixing device 6 is provided with the image heating first mode (normal mode) in which the ridge 13A is kept in the range of the fixation nip N in terms of the recording medium conveyance direction, to heat the unfixed image formed on a sheet P of recording medium which is no less in basis weight than a referential value (or on recording medium having first thickness). It is also provided with the image heating second mode (thin paper mode), in which the ridge 13A is positioned downstream side of the downstream end of the range of the fixation nip N in terms of the recording medium conveyance direction, to heat an image formed on the sheet P of recording medium, which is no more in basis weight than a referential value (or recording medium having second thickness which is less than first thickness). In this embodiment, the control portion 7 plays the role of making the image heating device 6 to operate in the image heating first mode or image heating second mode.

Incidentally, in this embodiment, the movement of the heating unit 10 is controlled based on the basis weight (or thickness) of a sheet P of recording medium. However, this embodiment is not intended to limit the present invention in terms of the parameter based on which the movement of the heating unit 10 is controlled. For example, the movement of the heating unit 10 may be controlled based on a table which shows the relationship between the recording medium type and how easily a sheet of recording medium of each type wraps around the fixation film 11, which is predetermined based on the correlation between the recording medium type, such as "ordinary", "photographic", "OHP film", and "thin" and the recording medium properties, such as basis weight, thickness, resiliency, rigidity, etc. That is, all that is necessary for the present invention to be applicable is that recording mediums are classified based on how easily each recording medium wraps around the fixation film 11.

4. Function of Ridge

In this embodiment, the ridge 13A of the pressure pad 13 is changed in position relative to the fixation nip N, based on the recording medium type. That is, it is placed within or outside the range of the fixation nip N in terms of the recording medium conveyance direction, based on the recording medium type. Further, the ridge 13A of the pressure pad 13 has two functions.

Figure 6:
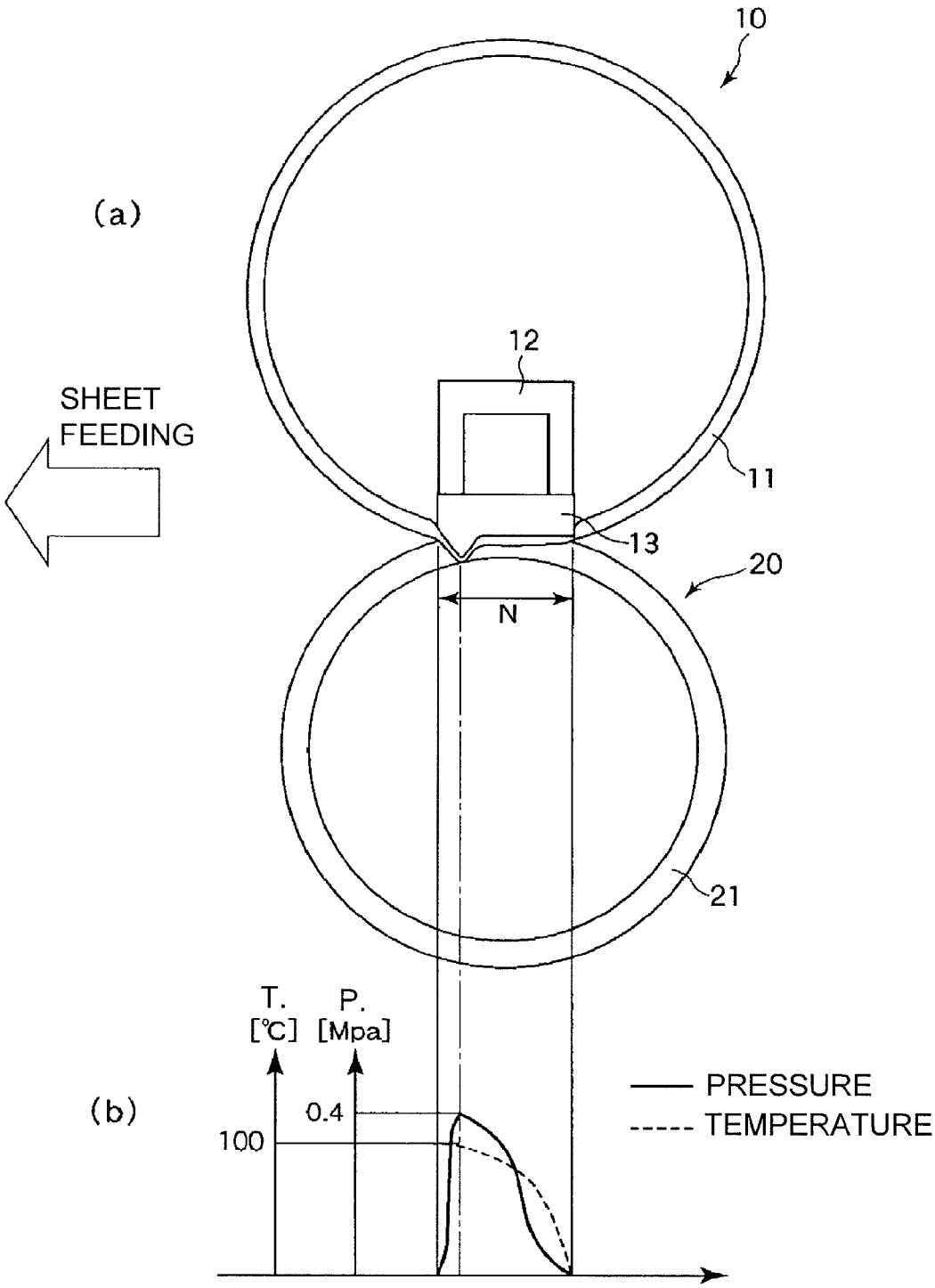
FIG. 6(*a*) is a schematic sectional view of the fixing device in the normal mode, and FIG. 6(*b*) is a graph which shows the pressure and temperature distributions of the fixing nip in the normal mode.
Figure 7:
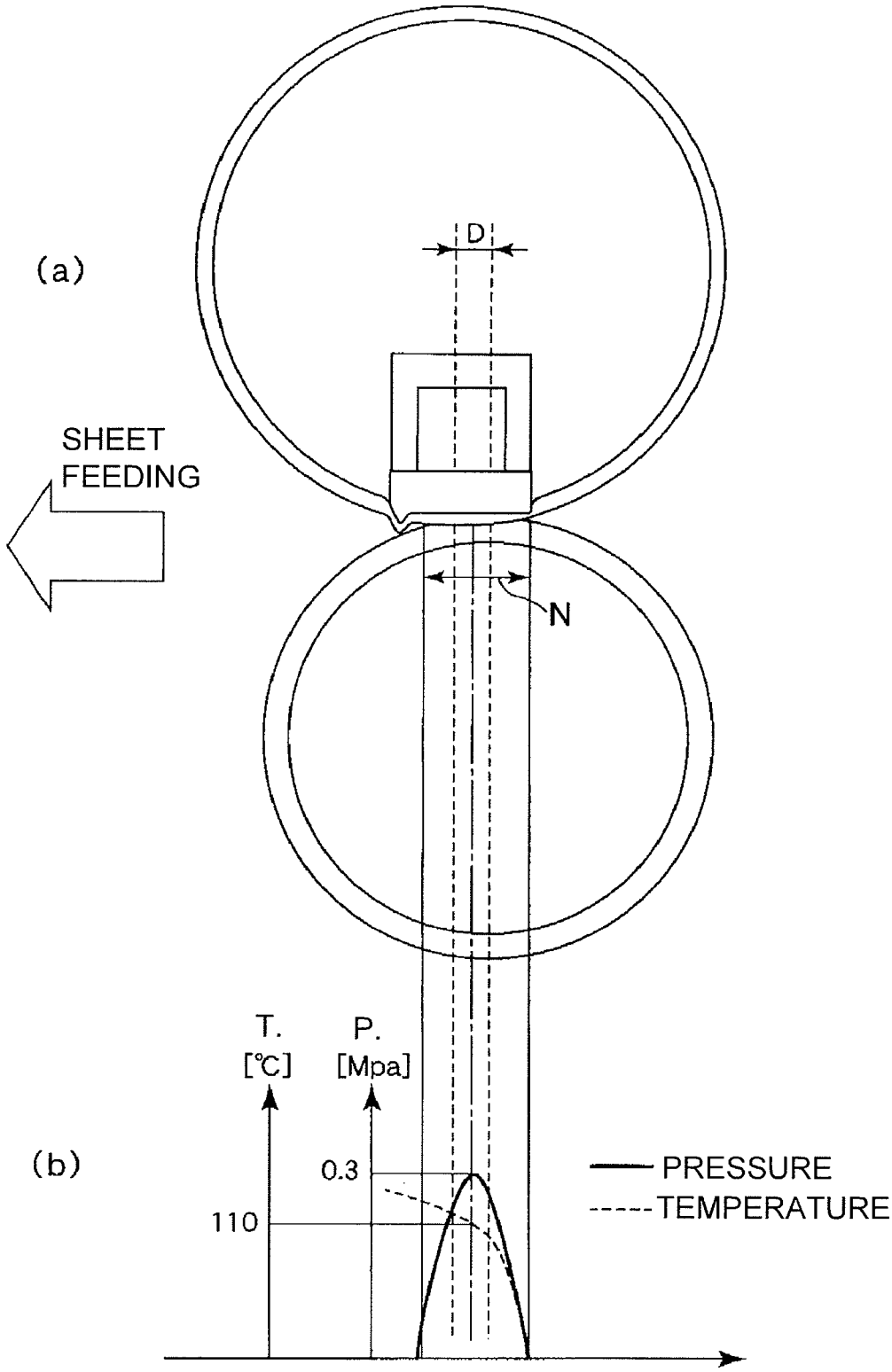
FIG. 7(*a*) is a schematic sectional view of the fixing device in the thin paper mode, and FIG. 7(*b*) is a graph which shows the pressure and temperature distributions of the fixing nip in the thin paper mode.
Figure 8:
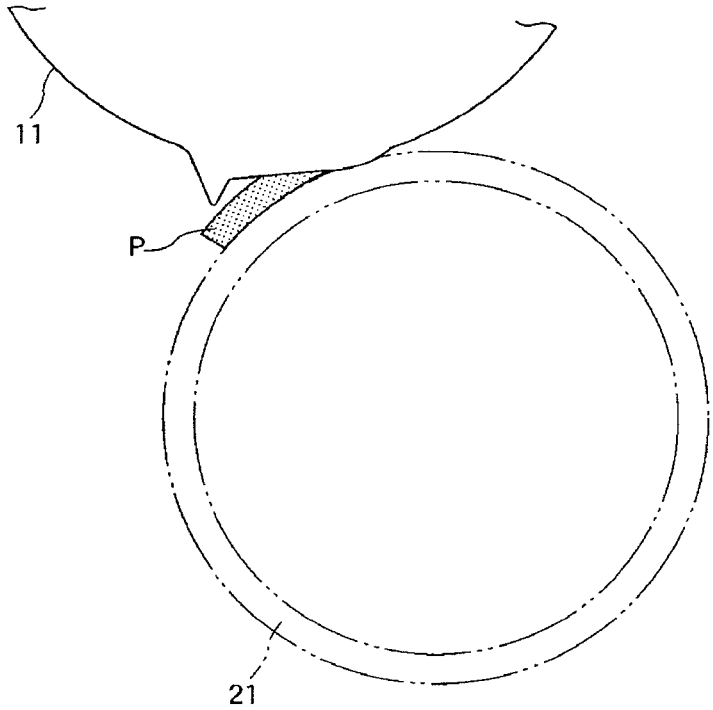
FIG. 8 is a schematic sectional view of the interface between the fixation roller and pressure roller, and its adjacencies, and shows the state of the leading edge portion of the sheet of recording medium when the sheet has just begun to come out of the fixation nip.

FIG. 6(*a*) is a schematic sectional view of the fixing device 6 in the normal mode, and FIG. 6(*b*) shows the distribution of the internal pressure (placed on sheet P of recording medium) in the fixation nip N, and the distribution of the internal temperature (applied to sheet P of recording medium) of the fixation nip N, when the image forming apparatus 100 is in the normal mode. FIG. 7(*a*) is a schematic sectional view of the fixing device 6 when the image forming apparatus 100 is in the thin paper mode, and FIG. 7(*b*) shows the distribution of the pressure placed on the sheet P of recording medium in the fixation nip N, and the temperature distribution in the fixation nip N, when the image forming apparatus 100 is in the thin paper mode. FIG. 8 shows the manner in which the sheet P of recording medium P is discharged from the fixation nip N when the image forming apparatus 100 is in the thin paper mode.

Referring to FIG. 6(*a*), one of the aforementioned functions of the ridge 13A of the pressure pad 13 is for when the ridge 13A of the pressure pad 13 is in the range of the fixation nip N in terms of the recording medium conveyance direction (normal mode). In this case, the pressure distribution of the fixation nip N in terms of the recording medium conveyance direction is as shown in FIG. 6(*b*). That is, in this case, the peak of the pressure distribution is in the fixation nip N, and on the downstream side of the center of the fixation nip N in terms of the recording medium conveyance direction. Thus, a large amount of pressure is applied to the sheet P while the surface temperature of the sheet P is high. Therefore, the toner particles are efficiently spread, raising thereby the level at which the glossiness of the fixed image will be as the fixed image comes out of the fixing device 6. In the normal mode, the highest amount of pressure to which the sheet P of recording medium is subjected in the fixation nip N is 0.4 Mpa, and the surface temperature of the sheet P of ordinary paper with a basis weight of 80 g/m$^2$, is 100° C.

Next, referring to FIG. 7(*a*), the second function of the ridge 13A of the pressure pad 13 is for when the ridge 13A of the pressure pad 13 is outside the fixation nip N in terms of the recording medium conveyance direction (thin paper mode). In this case, the fixation film 11 is deformed downward (toward pressure roller 21) by the ridge 13A of the pressure pad 13 in a pattern which reflects the cross section of the ridge 13A. Therefore, as the sheet P of recording medium is conveyed out of the fixation nip N, it is slightly downwardly angled, being thereby facilitated in terms of its separation from the fixation film 11.

Incidentally, it is not that a glossy image cannot be outputted in the thin paper mode. That is, a sheet P of thin paper is relatively small in basis weight, being therefore, smaller in thermal capacity, than a sheet P of ordinary paper which is thicker, being therefore greater in basis weight, than thin paper. Therefore, the amount by which heat is robbed from the fixation nip N by the sheet P of thin paper is smaller than that by the sheet P of ordinary paper. Thus, when the sheet P of thin paper is conveyed through the fixation nip N, the temperature of the center portion of the fixation nip N is higher than when the sheet P of ordinary paper is conveyed through the fixation nip N. Thus, the toner particles on the sheet P of thin paper are as well spread in the thin paper mode as the toner particles on the sheet P of ordinary paper are in the normal mode. This is why it is not that a glossy image cannot be outputted in the thin paper mode. In the thin paper mode, the amount of pressure placed on the sheet P of recording medium at the peak of the pressure distribution of the fixation nip N was 0.3 Mpa, and the surface temperature of the sheet P of thin paper which is 64 g/m$^2$ in basis weight was 110° C. Also in the thin paper mode, the heating unit 10 (ridge 13A of pressure pad 13) is positioned downstream by a distance D of 1.0 mm in terms of the recording medium conveyance direction, from the position in which the heating unit 10 (ridge 13A of pressure pad 13) is positioned in the normal mode.

The temperature in the fixation nip N can be measured by conveying a sheet P of recording medium with a pasted thermocouple (micro thin film thermocouple KFST-10-100-200: product of Anbesmt Co., Ltd.). As for the pressure distribution in the fixation nip N, it can be measured with the use of a tactile sensor (Sealer: product of Nitta Co., Ltd).

Referring to FIG. 6(*a*), in this embodiment, in the normal mode, the ridge 13A of pressure pad 13 is kept in the range of the fixation nip N in terms of the recording medium conveyance direction. Thus, an image outputted in the normal mode is higher in glossiness. Also in this embodiment, in the thin paper mode, the heating unit 10 is positioned 1.0 mm downstream of the position in which the heating unit 10 is positioned in the normal mode, in terms of the recording medium conveyance direction, so that the ridge 13A of the pressure pad 13 is positioned on the downstream side of the downstream end of the fixation nip N in terms of the recording medium conveyance direction, as shown in FIG. 7(*a*). With this placement of the heating unit 10 (ridge 13A), the path of the fixation film 11 dips downward (toward pressure roller 21) on the downstream side of the downstream end of the fixation nip N, in terms of the recording medium conveyance direction, causing thereby the sheet P of recording medium to be discharged from the fixing device 6 at a slightly downward angle. Thus, it is easier for the sheet P to separate from the fixation film 11.

5. Movement of Heating Unit

Figure 9:
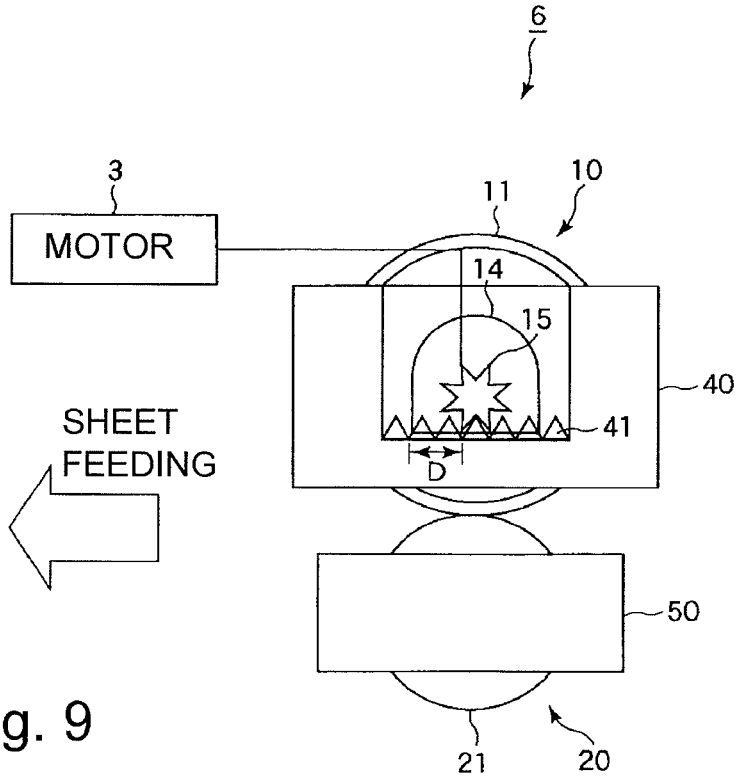
FIG. 9 is a schematic side view of the fixing device, and is for describing the method for moving the heating unit.

Next, the method for moving the heating unit 10 is described. FIG. 9 is a schematic side view of the fixing device 6, and FIG. 10 is a schematic top plan view of the fixing device 6.

First, referring to FIG. 9, the fixation film 11 is rotatably held by a fixation film flange 14, which has a gear 15 which is an integral part of the flange 14. The fixation film flange 14 is held by a flange supporting first metallic plate 40, which has a gear 41 (rack gear), which meshes with a gear 15 (pinion gear), which is an integral part of the fixation film flange 14. Further, the pressure roller 21 is rotatably supported by a second metallic plate 50.

Figure 10:
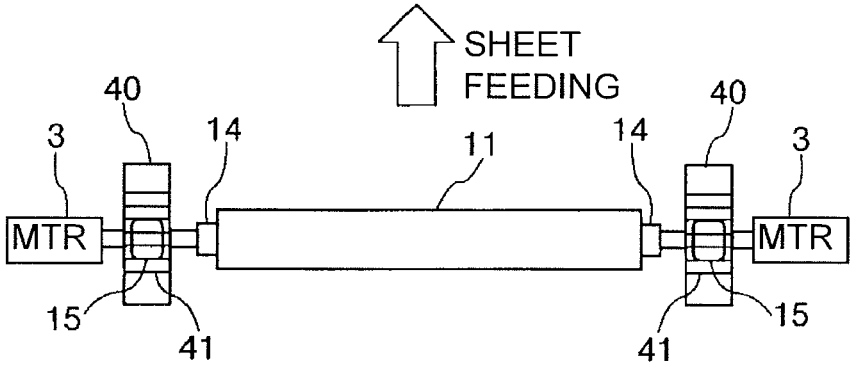
FIG. 10 is a schematic top plan view of the fixing device, and is for describing the method for moving the heating unit.

Next, referring to FIG. 10, the fixation film flange 14, first metallic plate 40, second metallic plate 50, gear 15, and motor 3 are at each of the lengthwise edges (which is roughly perpendicular to circular movement of fixation film 11). Those components which are at one of the lengthwise edges of the fixation film 11 are synchronous in movement with the counterparts which are at the other lengthwise edge.

As the motor 3 is driven, the gear 15 is rotated by the rotation of the motor 3, whereby the heating unit 10 is moved along the first metallic plate 40 in the direction parallel to the recording medium conveyance direction. Consequently, the ridge 13A of the pressure pad 13 is moved out of the fixation nip N in terms of the recording medium conveyance direction. In this embodiment, as the thin paper mode is selected, the heating unit 10 is moved by 1.0 mm in the recording medium conveyance direction by the rotation of the motor 3, and kept there. In this embodiment, the heating unit moving means of the image heating device 6, which is for moving the ridge 13A of the pressure pad 13 relative to the fixation nip N, comprises: the fixation film flange 14, gear 15, first metallic plate 40 having teeth 41 (rack gear), motor 3, motor control portion 4, etc.

Figure 11:
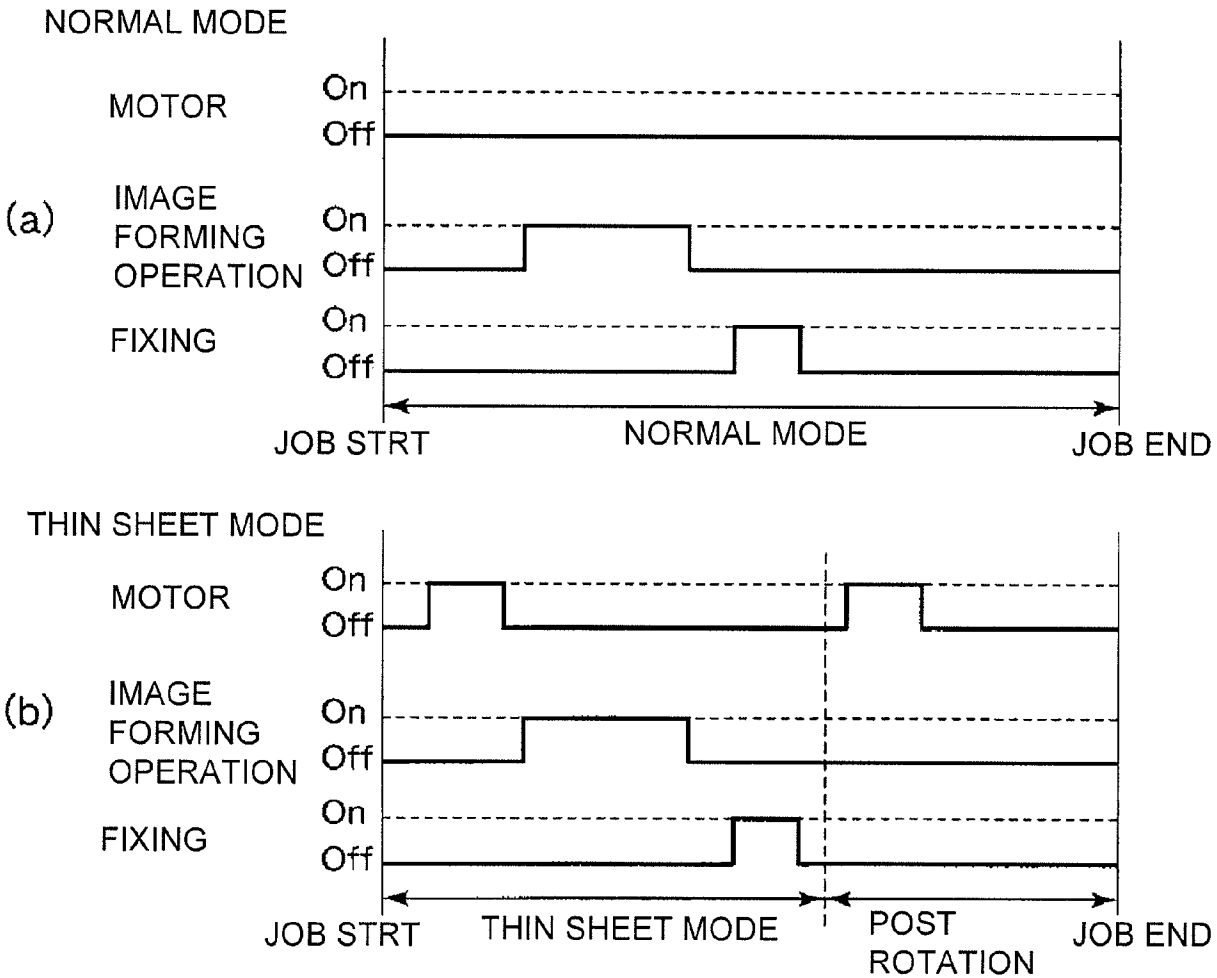
FIG. 11 is an example of the timing chart of the image outputting operation in accordance with the present invention.

FIGS. 11(*a*) and 11(*b*) show the timings with which the motor 3 and fixing device 6 are turned on or off during an image forming operation carried out in the normal and thin paper modes, respectively.

As the motor 3 is turned on for the first time in an image outputting job, the heating unit 10 is moved by 1.0 mm in the recording medium conveyance direction by the rotation of the motor 3. Then, as the motor 3 is turned on for the second time, the heating unit 10 is moved by 1.0 mm in the opposite direction to the recording medium conveyance direction by the rotation of the motor 3. On the other hand, as long as the motor 3 is kept turned off, the heating unit 10 remains where it is. During the period in which the "image forming operation" is ON, a toner image is formed through the charging process, exposing process, developing process, first transferring process, and second transferring process. During the period in which the "image forming operation" is OFF, no image is formed on a sheet P of recording medium. Further, during the period in which the "fixing operation" is ON, the fixation film 11 and pressure roller 21 are kept pressed against each other, and the fixation film 11 is circularly moved at 300 mm/s of peripheral velocity, to process the toner (particles) on the sheet P of recording medium to fix the toner image to the sheet P. On the other hand, during the period in which the "fixing operation" is OFF, the fixation film 11 and pressure roller 21 are kept separated from each other, and the fixation film 11 is circularly moved at 100 mm/s of peripheral velocity. Therefore, no image is fixed. A "post rotation period" means the period in which the image forming apparatus 100 (fixing device 6) is adjusted or prepared to end the on-going image forming operation. It is during this period that the operation for putting the heating unit 10 back into its default position (normal mode position) is carried out.

Referring to FIG. 11(*a*), in the normal mode, the heating unit 10 is positioned so that the ridge 13A of the pressure pad 13 of the fixing device 6 is positioned in the downstream end portion of the fixation nip N in terms of the recording medium conveyance direction. This state of the fixing device 6 is the default state of the fixing device 6. That is, in the normal mode, the motor 3 is not turned on. In other words, in the normal mode, images are formed and fixed without turning on the motor 3.

Next, referring to FIG. 11(*b*), in the thin paper mode, first the motor 3 is turned on, whereby the heating unit 10 is moved by 1.0 mm in the recording medium conveyance direction. Then, images are formed and fixed. Then, the motor 3 is again turned on, whereby the heating unit 10 is moved by 1.0 mm in the opposite direction to the recording medium conveyance direction.

Incidentally, all that is necessary is for the movement of the heating unit 10 to be completed before an image begins to be fixed. That is, the period in which the "image forming operation" is ON may overlap with the period in which the motor 3 is ON.

In this embodiment, the target temperature level for the fixation film 11 in the normal mode, that is, the level at which the temperature of the fixation film 11 is kept in the normal mode, is set to 180° C., whereas that in the thin paper mode is set to 165° C. Although in this embodiment, the level at which the temperature of the fixation film 11 is kept in the normal mode is different from that in the thin paper mode, both modes may be the same in the target temperature level for the fixation film 11. Further, in this embodiment, the dimension (width) of the fixation nip N in terms of the recording medium conveyance direction is set to 10 mm regardless of whether the image forming apparatus 100 (fixing device 6) is in the normal or thin paper mode.

Also in this embodiment, in the normal mode, the peak of the pressure distribution of the fixation nip N is on the downstream side of the center of the fixation nip N in terms of the recording medium conveyance direction. Thus, the image forming apparatus 100 (fixing device 6) in this embodiment is superior to any of the conventional image forming apparatuses (fixing devices 6), in terms of the glossiness level at which an image is outputted. Let's assume, for comparison, that a sheet P of recording medium which is greater in basis weight (no less than 80 g/m$^2$) than a sheet of ordinary paper is used, and the target temperature level for the fixation film 11 is adjusted without adjusting the fixing device 6 in the pressure distribution of the fixation nip N to change the position of the peak, in order to ensure that images to be outputted will be as glossy as the images outputted on a sheet P of ordinary paper. In this case, it is possible that the toner particles on the fibers of the sheet P of recording medium excessively melt, and therefore, "hot offset", that is, a problematic phenomenon that the toner particles on the sheet P of recording medium transfer onto the fixation film 11, will occur.

6. Modification of First Embodiment

The shape of the pressure pad 13 does not need to be limited to the one in this embodiment. That is, it may be shaped so that its cross section looks as shown in FIGS. 12 and 13.

Figure 12:
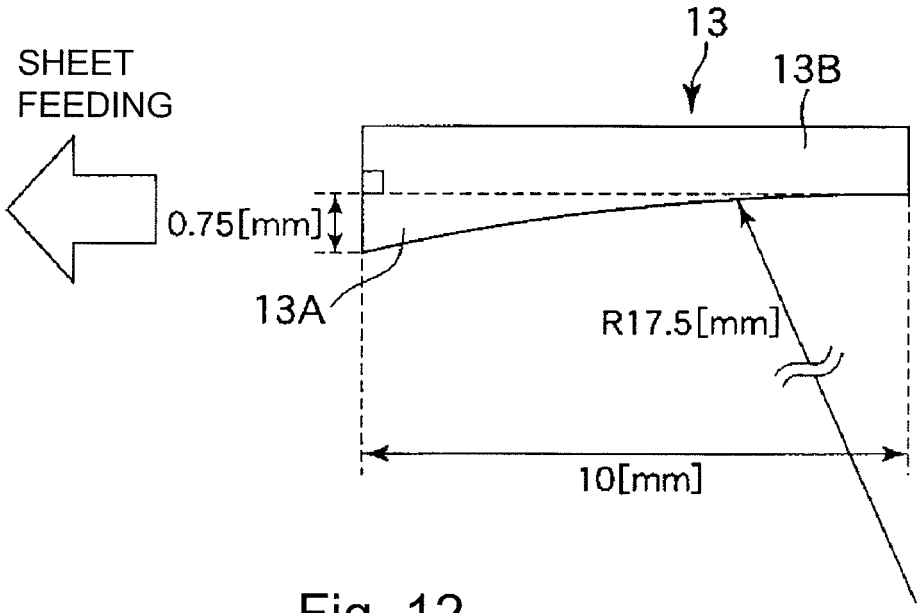
FIG. 12 is a schematic sectional view of an example of the pressure pad which is different from the pressure pad shown in FIG. 3.

The pressure pad 13 shown in FIG. 12 has a ridge 13A which is on the surface of the base 13B of the pressure pad 13, which faces the fixation film 11. The ridge 13A is shaped so that its peak is at the downstream end of the base 13B in terms of the recording medium conveyance direction. That is, the downstream surface of the ridge 13A is perpendicular to the base 13B, whereas the upstream surface of the ridge 13A gently declines from its downstream end toward its upstream end. Further, the shape of the ridge 13A is such that in terms of cross section, its upstream surface has a curvature, which is equal to the curvature of a circle which is 17.5 mm in radius. That is, the ridge 13A is zero in height at its upstream end, and very gradually increases in height toward the downstream end, being highest at the downstream end. Further, the ridge 13A faces downward. In the case of the pressure pad 13 shown in FIG. 12, the height of the tip of its ridge 13A from the base 13B is 0.75 mm. Further, the dimension (width) of the pressure pad 13 in terms of the recording medium conveyance direction is 10 mm.

The pressure pad 13 shown in FIG. 13 has a ridge 13A, which is rectangular in cross section. The ridge 13A is on the surface of the base 13B, on which the fixation film 11 slides. The ridge 13A is positioned so that it is located 3.5 mm downstream from the center of the base 13B. It is 0.5 mm in height and 1.0 mm in width (dimension in terms of recording medium conveyance direction).

Further, in the first embodiment, the heating unit 10 is moved to move the ridge 13A of the pressure pad 13 into the fixation nip N. However, the first embodiment is not intended to limit the present invention regarding the movement of the ridge 13A. For example, it may be the pressure roller 21 that is moved to move the ridge 13A of the pressure pad 13 into, or out of, the fixation nip N.

Also in this embodiment, the type of the recording medium to be used for outputting an image is selected by an operator with the use of the control panel 1 of the image forming apparatus 100. However, this embodiment is not intended to limit the present invention in terms of the method for setting the recording medium type. For example, the image forming apparatus 100 may be provided with an automatic recording medium type detecting means so that the recording medium type is automatically determined by detecting the thickness, surface properties, basis weight, and the like parameters of a sheet P of recording medium, with the use of the sensors with which the image forming apparatus 100 is provided.

As described above, in this embodiment, the ridge 13A of the pressure pad 13 is switched in the position relative to the fixation nip N according to the type of recording medium. Thus, it is possible to make the fixing device 6 to satisfactorily separate a sheet P of recording medium from the fixation film 11 even if the sheet P of recording medium is such a sheet of recording medium that tends to wrap around the fixation film 11, without sacrificing the function of outputting a highly glossy image. That is, as is evident from the description of this embodiment given above, the present invention can provide a fixing device 6 capable of separating even a sheet P of recording medium, which is low in rigidity, from the fixation film 11, without sacrificing glossiness.

[Embodiment 2]

Next, the second preferred embodiment of the present invention is described. The image forming apparatus in this embodiment is the same in basic structure and operation as the image forming apparatus in the first preferred embodiment. Therefore, the components of the image forming apparatus in this embodiment, which are the same in function and structure as, or equivalent in function and structure to, the counterparts in the first embodiment, are given the same referential codes as those given to the counterparts, one for one, and are not described in detail.

In the first embodiment, it was assumed that the sheets P of recording medium which are being used for an image forming job is not replaced with sheets P of recording medium of a different type during the same image forming job. In comparison, in this embodiment, however, the sheets P of recording medium which are being used for an image forming job are replaced with sheets P of recording medium of a different type during the same image forming job.

Also in this embodiment, the "normal mode (image heating first mode)" is for outputting such an image that is highly glossy and brilliant in color, with the use of a sheet P of recording medium which is no less in basis weight than 80 g/m$^2$, as it was in the first embodiment. Further, the "thin paper mode (image heating second mode)" is for delivering a fixed image from the fixing device 6 reliably, that is, while preventing the sheet P of recording medium from jamming the fixing device 6 by wrapping around the fixation film 11 even when a sheet P of thin paper, film, etc., which is no more in basis weight than 80 g/m$^2$, being therefore very low in rigidity, is used as recording medium. In other words, the "normal mode (image heating first mode)" may be deemed as a mode in which a highly glossy and highly brilliant color image can be outputted with the use of a sheet P of recording medium, the thickness of which is the first thickness, whereas the "thin paper mode (image heating second mode)" may be deemed as the mode in which even if a sheet P recording medium, the thickness of which is the second thickness which is less than the first thickness, is used for image formation, a fixed image is delivered from the fixing device 6 reliably, that is, without causing the sheet P to jam the fixing device 6 by wrapping around the fixation film 11.

Referring to FIG. 1, in this embodiment, the first cassette 109*a* stores sheets P of ordinary paper, and the second cassette 109*b* stores sheets P of thin paper. The relationship between the cassette number and the type of the sheet P of recording medium in the cassette is registered in the memory 5 of the control portion 7 of the image forming apparatus 100 through the control panel 1 of the image forming apparatus 100.

Figure 14:
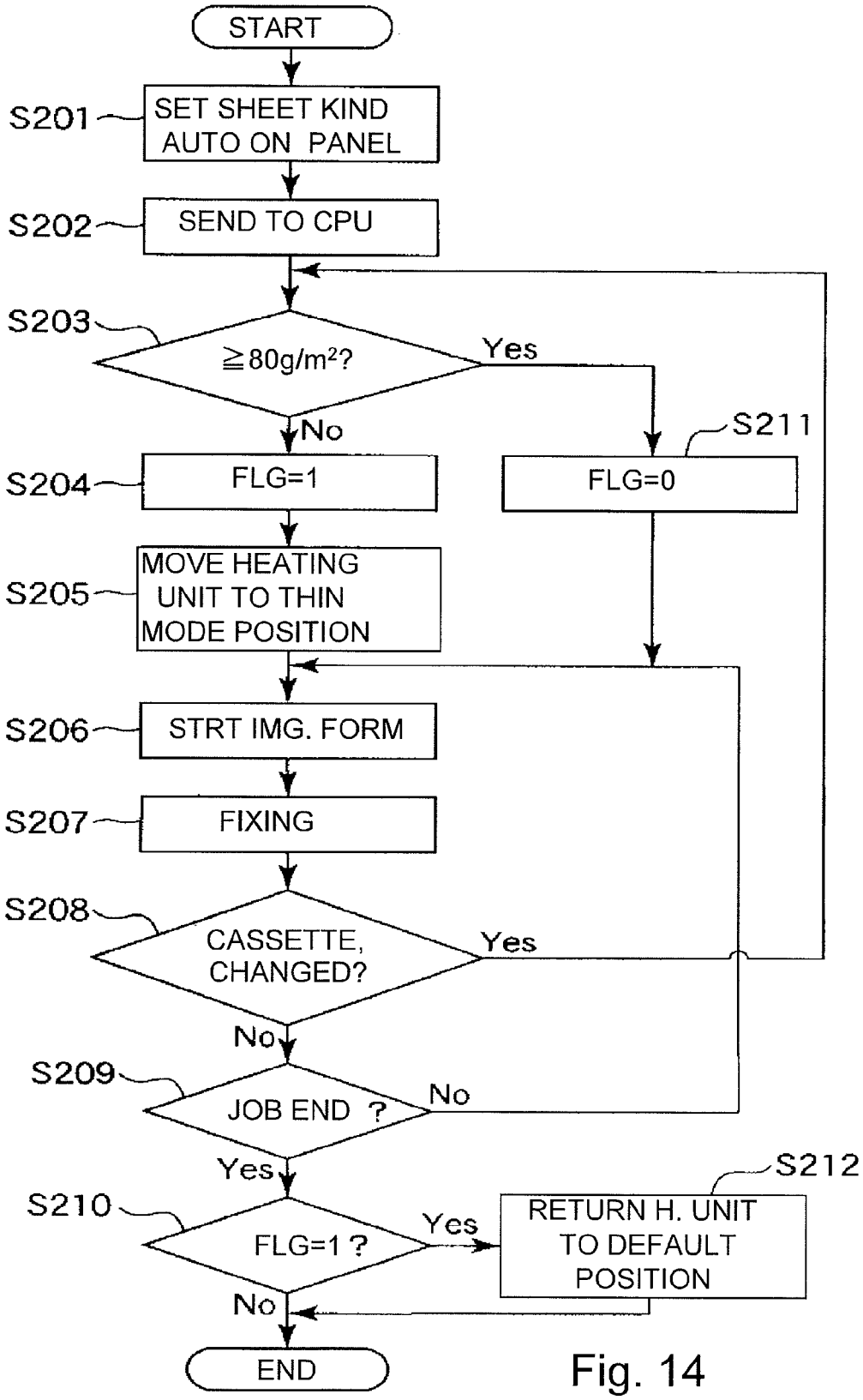
FIG. 14 is another example of the flowchart of the image outputting operation in accordance with the present invention.

FIG. 14 is a flowchart of the operational sequence, in this embodiment, for moving the heating unit 10.

As an operator sets the image forming apparatus 100 through the control panel 1 of the image forming apparatus 100 so that the image forming apparatus 100 automatically selects proper recording medium (S201), the information regarding the recording medium in the first cassette 109, which is the first to be used, is transmitted to the CPU 2 of the control portion 7 (S202). Then, based on this information and the information stored in advance in the memory 5, the CPU 2 determines whether or not the recording medium to be used for a given image formation job has to be no less than 80 g/m$^2$ in basis weight (S203). If the CPU 2 determines in S203 that the recording medium P is no less than 80 g/m$^2$ in basis weight, it places a flag 0 in the memory 5 (S211). At this stage in the operation, the position of the heating unit 10 is the default position, that is, such a position that the ridge 13A of the pressure pad 13 is within the range of the fixation nip N in terms of the recording medium conveyance direction. Then, the image forming operation is started (S206), and the image fixing process is carried out (S207).

On the other hand, if the CPU 2 determines that the recording medium P is no more than 80 g/m$^2$ in basis weight, it places a flag 1 in the memory 5 (S204). Then, it causes the motor control portion 4 to control the motor 3 according to the information from the CPU 2 so that the heating unit 10 is moved by 1.0 mm in the recording medium conveyance direction (S205). In other words, the heating unit 10 is moved to the thin paper mode position, in which the ridge 13A of the pressure pad 13 of the heating unit 10 is on downstream side of the downstream end of the fixation nip N in terms of the recording medium conveyance direction. Then, the image forming operation is started (S206), and the image fixing process is carried out (S207).

During the image forming operation, the CPU 2 checks whether or not the first cassette 109*a* has run out of a sheet of recording medium P, that is, whether or not the recording medium delivery is to be switched from the first cassette 109*a* to the second cassette 109*b* (S208). If it determines that recording medium delivery does not need to be switched from the first cassette 109*a* to the second cassette 109*b*, it checks whether or not the current job has been completed (S209). On the other hand, if the CPU 2 determines that the recording medium delivery has to be switched from the first cassette 109*a* to the second cassette 109*b*, it switches the recording medium delivery from the first cassette 109*a* to the second cassette 109*b*, and returns to S203, in which it again determines the type of the recording medium P to start the subsequent control sequence.

If the CPU 2 determines in S209 that the current job has not been completed, it returns to S206, in which it makes the image forming apparatus 100 form images. Then, it makes the fixing device 6 fix images (S207). On the other hand, if the CPU 2 determines in S209 that the current job has been completed, it determines, with reference to the flag in the memory 5, whether or not the heating unit 10 is in the thin paper mode position (S210). If it determines that the heating unit 10 is not in the thin paper position, it ends the image outputting operation. On the other hand, if it determines that the heating unit 10 is in the thin paper mode position, it sends the information regarding the position of the heating unit 10 to the motor control portion 4, causing thereby the motor control portion 4 to control the motor 3 according to the information. Thus, the heating unit 10 is moved by the motor 3 in the direction opposite to the recording medium conveyance direction by 1.0 mm (S212). In other words, the heating unit 10 is returned to the normal mode position, in which the ridge 13A of the pressure pad 13 of the heating unit 10 is within the range of the fixation nip N in terms of the recording medium conveyance direction. Then, the CPU 2 ends the on-going image outputting operation.

Referring to FIG. 6(*a*), in this embodiment, in the normal mode, the fixing device 6 is in the state in which the ridge 13A of the pressure pad 13 is within the fixation nip N in terms of the recording medium conveyance direction. Therefore, the image forming apparatus 100 can output an image at a higher level of glossiness than when the fixing device 6 is in the state in which the ridge 13A is out of the fixation nip N. Next, referring to FIG. 7(*a*), also in this embodiment, in the thin paper mode, the fixing device 6 is in the state in which the heating unit 10 has been moved downstream by 1.0 mm in the recording medium conveyance direction, and therefore, the ridge 13A of the pressure pad 13 is on the downstream side of the downstream end of the fixation nip N. Thus, the fixation film path sharply dips (bend toward pressure roller 21) on the downstream side of the downstream end of the fixation nip N, causing thereby the sheet of recording medium P to be discharged at a downward angle (toward pressure roller 21). In other words, in the thin paper mode, the sheet of recording medium P is better facilitated to separate from the fixation film 11 than in the normal mode.

Figure 15:
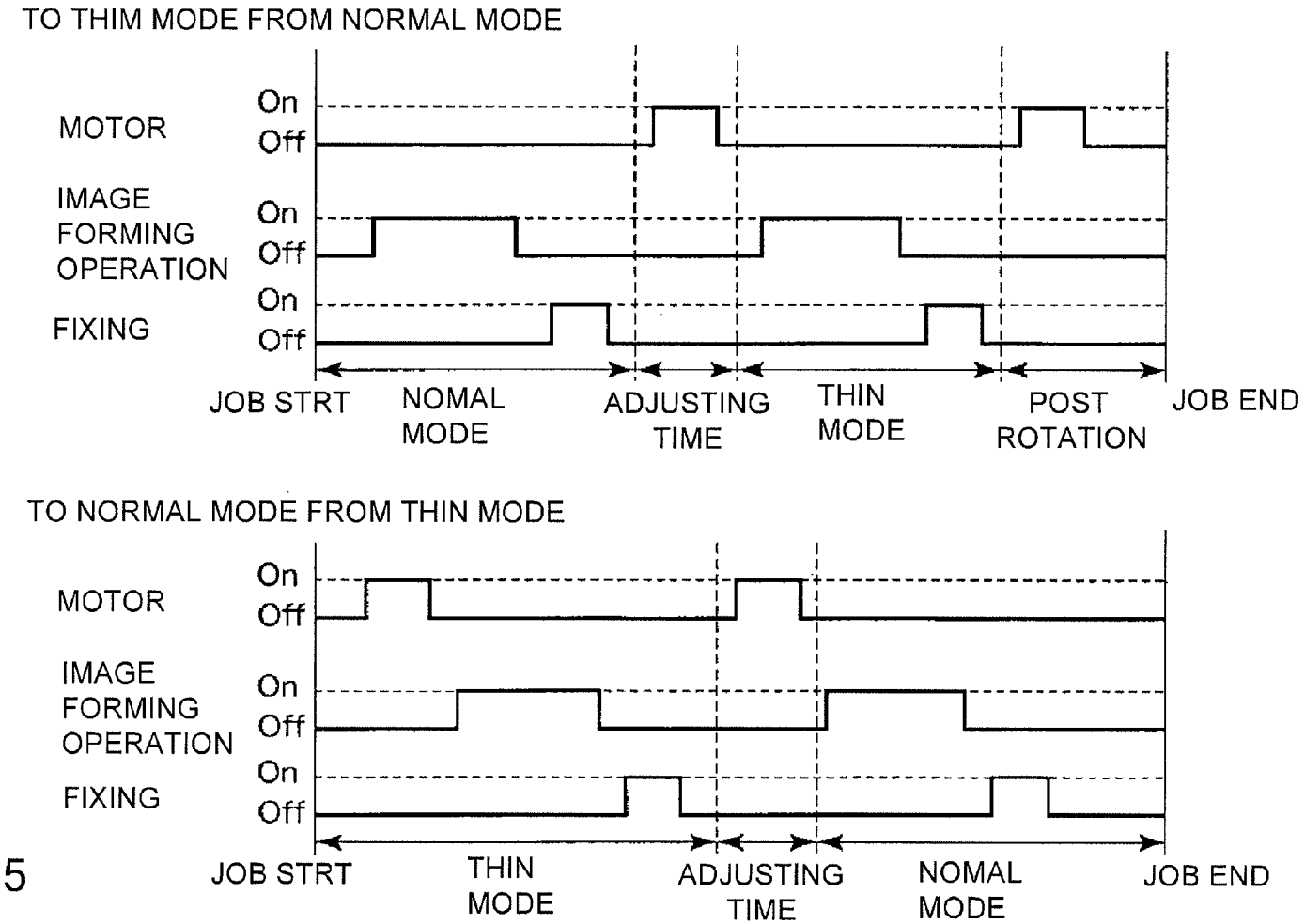
FIG. 15 is another timing of the image outputting operation in accordance with the present invention.

FIG. 15(*a*) is a timing chart of an image forming operation in which the image forming apparatus 100 (fixing device 6) is switched in operational mode from the normal mode to the thin paper mode during an image forming operation, whereas FIG. 15(*b*) is a timing chart of an image forming operation in which the image forming apparatus 100 (fixing device 6) is switched in operational mode from the thin paper mode to the normal mode during an image forming operation. FIGS. 15(*a*) and 15(*b*) show the timing with which the motor 3, image forming stations, and fixing device are turned on and off. The timing with which the abovementioned components of the image forming apparatus 100 in this embodiment are turned on or off in an operation in which switching is done between the two cassette 109*a* and 109*b* is the same as the timing with which the abovementioned components of the image forming apparatus 100 in the first embodiment are turned on or off, as shown in FIGS. 11(*a*) and 11(*b*).

In the first period in which the motor 3 is ON, the heating unit 10 is moved by 1.0 mm in the recording medium conveyance direction. In the second period in which the motor is ON, the heating unit 10 is moved by 1.0 mm in the opposite direction to the recording medium conveyance direction. On the other hand, in the periods in which the motor 3 is OFF, the heating unit 10 is not moved. In the periods in which the image forming stations are ON, an image is being formed on a sheet of recording medium P through the charging, exposing, developing, first transferring, and second transferring processes. In the periods in which the image forming stations are OFF, no toner image is being formed on a sheet of recording medium P. In the periods in which fixing device 6 is ON, the toner (toner image) on a sheet of recording medium P is being processed (fixed) by keeping the fixation film 11 and pressure roller 21 pressed upon each other, and circularly moving the fixation film 11 at 300 mm/s of peripheral velocity. On the other hand, in the periods in which the fixing device 6 is OFF, the fixation film 11 and pressure roller 21 are kept separated from each other, and the fixation film 11 is circularly moved at 100 mm/s of peripheral velocity. In other words, no image is being processed (fixed) by the fixing device 6. A "post-rotation period" is a period in which adjustments or preparations are made to end the on-going image formation operation. It is during the post-rotation period that the operation for moving the heating unit 10 back into the default position (normal mode position) is carried out.

In this embodiment, the target temperature for the fixation film 11 in the normal mode is set to 180° C., and the target temperature for the fixation film 11 in the thin paper mode is set to 165° C. In this embodiment, the normal mode and thin paper mode are made different in the target temperature for the fixation film 11. However, they do not need to be made different in the target temperature for the fixation film 11. Further, the dimension (width) of the fixation nip N in terms of the recording medium conveyance direction is set to 10 mm regardless of whether the image forming apparatus 100 (fixing device 6) is in the normal mode or thin paper mode.

Next, referring to FIG. 15(*a*), the operational sequence for switching from the normal mode to the thin paper mode in the midst of an image formation job is described. Since the image forming apparatus 100 is in the normal mode, the heating unit 10 is in the default position, in which the ridge 13A of the pressure pad 13 of the heating unit 10 is in the range of the fixation nip N in terms of the recording medium conveyance direction. In the normal mode, an image is fixed while the heating unit 10 is in the default position. Therefore, the motor 3 is not turned on to move the heating unit 10. That is, in the normal mode, an image is formed while the fixing device 6 is in the above-described state. Thereafter, if the cassette 109*a* for the ordinary paper, that is, the cassette 109 from which sheets of recording medium P has been fed, becomes empty, the cassette 109 from which recording medium P is to be fed is switched to the cassette 109*b* for thin recording medium. Thus, as the cassette 109*a* becomes empty, an adjustment period is provided, during which the motor 3 is activated to move the heating unit 10 by 1.0 mm in the recording medium conveyance direction, and also, the target temperature for the fixation film 11 is reduced from 180° C. to 165° C. Then, the interrupted image forming operation is restarted, and the image fixing process is carried out. As soon as the on-going image formation job is completed, the motor 3 is activated again to return the heating unit 10 to the default position.

Next, referring to FIG. 15(*b*), the operational sequence for switching from the thin paper mode to the normal mode in the midst of an image formation job is described. At the beginning of a given image formation job, the heating unit 10 is in its default position, in which the ridge 13A of the pressure pad 13 of the heating unit 10 is in the fixation nip N in terms of the recording medium conveyance direction. In the thin paper mode, however, the ridge 13A of the pressure pad 13 has to be outside the fixation nip N, and on the downstream side of the downstream end of the fixation nip N in terms of the recording medium conveyance direction. Therefore, as the operational mode of the image forming apparatus 100 is switched from the normal mode to the thin paper mode, the motor 3 is activated to move the heating unit 10 by 1.0 mm in the recording medium conveyance direction. Then, the image forming processes are carried out, and then, the image fixing process is carried out. In such a situation that the cassette 109*b* from which sheets of thin recording medium P have been fed becomes empty, and therefore, the cassette 109 from which sheets of recording medium P is to be fed has to be switched from the cassette 109*b* to the cassette 109*a* which stores sheets of ordinary paper, an adjustment period is provided as soon as the cassette 109*b* becomes empty. In the adjustment period, the motor 3 is activated to move the heating unit 10 in the opposite direction to the recording medium conveyance direction by 1.0 mm. In addition, the target temperature for the fixation film 11 is raised from 165° C. to 180° C. Then, the interrupted image forming job is restarted, and then, the image fixing process is carried out. Thus, at the end of the job, the heating unit 10 is in its default position, and therefore, the motor 3 is not activated.

As described above, in this embodiment, if recording medium is switched from one type to another in the midst of an image formation job, the fixing device 6 is switched in the position of the ridge 13A of the pressure pad 13 according to recording medium type. Therefore, even if recording medium is switched from one type to another in the midst of an image formation job, the image forming apparatus 100 (fixing device 6) can output a glossy image while preventing recording medium from failing to properly separate from the fixation film 11.

[Embodiment 3]

Next, another preferred embodiment of the present invention is described. The image forming apparatus in this embodiment is the same in basic structure and operation as the image forming apparatus in the first preferred embodiment. Therefore, the components of the image forming apparatus in this embodiment, which are the same in function and structure as, or equivalent in function and structure to, the counterparts in the first embodiment, are given the same referential codes as those given to the counterparts, one for one, and are not described in detail.

The first and second embodiments of the present invention were described with reference to a case in which the amount by which toner is transferred (deposited) on recording medium P to form a monochromatic image is relative large. In this embodiment, the present invention is described with reference to a case in which the amount by which toner is transferred onto a sheet of recording medium P to form a monochromatic image on the sheet is relatively small.

In recent years, concern regarding environment has been increasing, and also, consumers are demanding further reduction in the cost of an image forming apparatus. Thus, the technologies for reducing an image forming apparatus in toner consumption have become very important. The technologies for reducing an image forming apparatus in toner consumption have come to play an important role from the standpoint of reducing an image forming apparatus in the amount of energy used to fix toner to recording medium.

One of the methods which can be used to reduce an image forming apparatus in toner consumption is to increase the filler of toner in terms of its ratio to coloring agent of toner, in order to reduce an image forming apparatus in the overall amount of toner consumption per sheet of recording medium. This method, however, is problematic for the following reason. That is, reducing the amount by which toner is adhered to recording medium per unit area of recording medium means reducing the amount by which toner is adhered (transferred) onto a sheet of recording medium per unit area to form a solid monochromatic. Thus, if the amount by which toner is adhered to recording medium is reduced, it is possible that spaces may remain among the toner particles which make up the solid monochromatic image. Thus, the image bearing area of the surface of recording medium may fail to be fully covered with toner while the image is fixed, because the surface of recording medium is microscopically irregular in texture.

In particular, if a sheet of recording medium P used for image formation is greater in irregularity in terms of texture and thermal capacity, toner is unlikely to fully melt. Therefore, the image forming apparatus 100 (fixing device 6) is likely to output an image which is low in reflection density.

At this time, the amount by which toner is adhered to recording medium to form a monochromatic solid image is described. It is assumed here that a monochromatic solid image is formed under the condition in which toner particles idealistically align as they are transferred onto recording medium.

FIG. 16 is a list which shows the parameters of toner, which are related to the idealistic toner particle alignment. Letters L [μm] and V [μm3] stand for the average particle size (diameter) of the toner and the average particle volume of the toner, respectively. A letter S [μm3] stands for the average projected area of the toner particles. Further, a letter Sb [μm2] stands for the average size of the recording medium surface per toner particle. There are following mathematical relationships among the abovementioned parameters.

$$V = \frac{4}{3}\pi\left(\frac{L}{2}\right)^3$$

$$Sa = \pi\left(\frac{L}{2}\right)^2$$

$$Sb = \frac{\sqrt{3}}{2}L^2$$

When a monochromatic toner image is formed on a sheet of recording medium under the condition in which toner particles align with the presence of virtually no gap between adjacent two toner particles, the amount H [μm] (volume per unit area=average height of toner layer) of toner on a portion of recording medium which corresponds to an actual image, which is formed of a single layer of toner particles, can be obtained from Mathematical Formula 4.

$$H = \frac{V}{Sb} = \frac{4}{3}\pi\left(\frac{L}{2}\right)^3 \cdot \frac{2}{\sqrt{3}L^2} = \frac{\pi L}{3\sqrt{3}}$$

In the case of Mathematical Formula 4 given above, in consideration of the state of toner particle alignment, it is assumed that "toner volume [μm] per unit area" equals "average height". Normally, however, the weight per unit area [mg/m$^2$] of toner is used to control the amount by which toner is transferred onto recording medium. Therefore, Formula 4 which is for calculating the amount of toner on a portion of recording medium which corresponds to an actual image, which is formed of a single layer of toner particles, when the toner particle alignment is idealistic (toner particles are truly spherical and align with virtually no gap between adjacent to toner particles), is converted into the following Mathematical Formula (1) as the formula for obtaining the amount A [mg/m$^2$] of toner per unit area of the actual image portion of a monochromatic image on a sheet of recording medium. Incidentally, a term 1/10 in the following Mathematical Formula (1) is for the measurement unit normalization.

$$A = \rho \times H = \rho \times \frac{1}{10} \times \frac{\pi L^3}{3\sqrt{3}L^2} = \frac{\rho\pi L}{30\sqrt{3}} \quad (1)$$

If the amount by which toner is transferred onto a sheet of recording medium per unit area (amount of toner, per unit area, of solid area of monochromatic image) to form a monochromatic image on the sheet of recording medium is less than the value calculated by Formula (1) given above, that is, if it satisfies Mathematic Formula (inequity) (2) given below, the resultant monochromatic image will be insufficient in reflection density.

$$A < \rho\pi L/(30\sqrt{3})$$

This embodiment is described with reference to a case in which the amount by which toner is transferred onto a sheet of recording medium, per unit area of the sheet of recording medium, is less than the value calculated with the use of Mathematical Formula (1) given above. More concretely, the toner used in this embodiment is 5.5 μm in average particle diameter, and 1.1 g/cm$^3$ in specific gravity. The amount by which toner is transferred onto a sheet of recording medium to form a solid monochromatic portion of the image is 0.3 mg/m$^2$. The maximum amount by which toner is transferred onto a sheet of recording medium is 0.6 mg/m$^2$.

As described above, if the amount by which toner is transferred onto a sheet of recording medium (paper in particular) to form a solid portion of the monochromatic image of the primary color is insufficient, the toner delivered to this portion of the sheet of recording medium fails to completely cover the surface of each of the fibers of which the sheet of recording medium is made of. Thus, the resultant image is insufficient in reflection density. Thus, in order to output an image which is satisfactory (sufficient) in reflection density, it is desired that each toner particle is spread wider by the fixing device 6 than if the aforementioned amount is sufficient.

Figure 17:
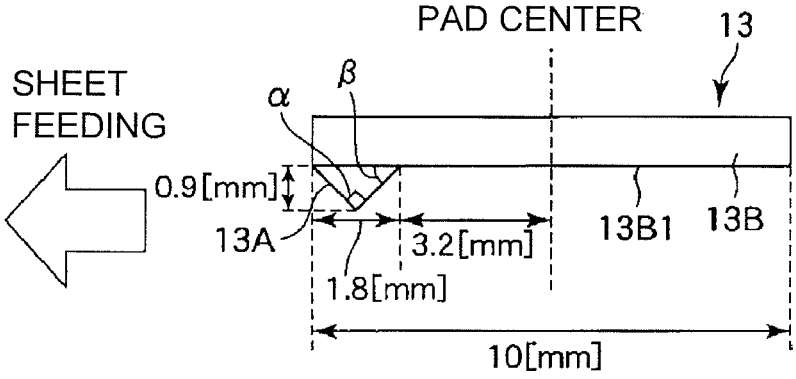
FIG. 17 is a schematic sectional view of yet another example of the pressure pad in accordance with the present invention.

In this embodiment, therefore, in order to spread each toner particle wider, the fixing device 6 is provided with a pressure pad 13, the cross sectional shape of which is shown in FIG. 17. The pressure pad 13 used in this embodiment is roughly the same in structure as that used in the first embodiment. That is, it has a base 13B and a ridge 13A. The ridge 13A is on the surface 13B1 of the base 13B, on which the fixation film 11 slides.

To describe in more detail, in this embodiment, the dimension (width) of the pressure pad 13 in terms of the recording medium conveyance direction is 10 mm. The ridge 13A is triangular in cross section. The dimension (width) of the ridge 13A in terms of the recording medium conveyance direction is 1.8 mm. The downstream edge of the ridge 13A coincides with the downstream edge of the base 13B, whereas the upstream edge of the ridge 13A is located 3.2 mm downstream from the center of the pressure pad 13. Further, the ridge 13A is 0.9 mm in height. That is, in this embodiment, the tip of the ridge 13A in terms of the triangular cross section of the ridge 13A is located 4.1 mm downstream from the center of the pressure pad 13. Further, the apex angle $\alpha$ of the ridge 13A is 90 degrees, and the angle $\beta$ between the two lateral surfaces of the ridge 13A is 45 degrees.

In this embodiment, the ridge 13A is made taller than in the first and second embodiments. Therefore, the fixation nip N in this embodiment is greater in internal pressure than those in the first and second embodiments, and therefore, the fixing device 6 in this embodiment can spread a toner particle wider, being therefore higher in the level at which the reflection density of the fixed image will be, than the fixing devices 6 in the first and second embodiments.

Shown in Table 1 are the amount of the maximum pressure in the fixation nip N, that is, the pressure between the tip (peak) of the ridge 13A of the pressure pad 13, which is 0.9 mm in height, and fixation film 11, in this embodiment, and the maximum internal pressure of the fixation nip N, that is, the pressure between the tip (peak) of the ridge 13A of the pressure pad 13, which is 0.75 mm in height, and the fixation film 11, in the first embodiment. Table 1 shows also the reflection density of the solid portion of the image fixed with the use of the pressure pad 13 in this embodiment, and the reflection density of the solid portion of the image fixed with the use of the pressure pad 13 in the first embodiment.

The pressure distribution was measured with the use of a tactile sensor (Sealer: product of Nitta Co., Ltd.). As for the reflection density, it was measured with the use of a spectral densitometer 503 (product of X-Rite Co., Ltd.).

TABLE 1

| Ridge height (mm) | Peak pressure (Mpa) | Reflection density |
|---|---|---|
| 0.9 | 0.5 | 1.45 |
| 0.75 | 0.4 | 1.32 |

According to Table 1, the fixing device 6, in this embodiment, which used the pressure pad 13, the height of the ridge 13A of which was 0.9 mm, was higher in the maximum internal pressure of the fixation nip N, that is, the pressure between the tip (peak) of the ridge 13A and the fixation film 11 than the fixation device 6 in the preceding embodiments. Thus, the fixing device 6 in this embodiment can spread wider each toner particle than the fixing devices 6 in the preceding embodiments, and therefore, the fixing device 6 is compensated in glossiness, for the insufficiency in the amount by which toner is transferred onto a sheet of recording medium.

Also in this embodiment, in a case where a sheet of recording medium P used for outputting an image is a sheet of ordinary paper or the like (which is no less than 80 g/m$^2$ in basis weight; first thickness), the heating unit 10 is positioned as follows: That is, the heating unit 10 is positioned so that the ridge 13A of its pressure pad 13 is positioned in the downstream end portion of the fixation nip N in terms of the recording medium conveyance direction. In this embodiment, therefore, a larger amount of pressure than the amount of pressure applied to the toner particles on a sheet of recording medium in the fixation nip N in the preceding embodiment is applied to the toner particles on the sheet of recording medium, in the area of fixation nip N, which is higher in temperature. Therefore, the toner particles are spread wider, being enable to satisfactorily hide (cover) each of the fibers of which the recording medium P is made.

On the other hand, in a case where the recording medium P used for image formation is a sheet of thin paper or the like (which is no more than 80 g/m$^2$ in basis weight, or the thickness of which is the second thickness which is less than the first thickness), the recording medium P is smaller in thermal capacity, and therefore, the toner particles on the recording medium P quickly increase in temperature. Therefore, even if the amount of the pressure applied to the toner particles in the downstream end portion of the fixation nip N is no larger than the normal one, the toner particles are spread wider anyway. In this case, the heating unit 10 is positioned so that the ridge 13A of its pressure pad 13 is positioned on the downstream side of the downstream end of the fixation nip N in terms of the recording medium conveyance direction. This placement of the heating unit 10 improves the fixing device 6 in terms of the recording medium separation from the fixation film 11.

As for the method for changing the fixing device 6 in terms of the position of the ridge 13A of the pressure pad 13 relative to the fixation nip N, the method similar to those used in the first and second embodiments can be used.

As described above, according to this embodiment, even if an image forming apparatus (100) is designed to be smaller in the amount by which toner is adhered to a sheet of recording medium to form a monochromatic solid portion of an image than a conventional image forming apparatus, the image forming apparatus can be made to output a desirably glossy image without sacrificing the separation of recording medium from the fixation film, by structuring the image forming apparatus so that the ridge 13A of the pressure pad 13 of the heating unit 10 of its fixing device can be switched in position relative to the fixation nip N of the fixing device 6 according to recording medium type.

[Miscellaneous Embodiments]

The present invention has been described with reference to the preferred embodiments of the present invention. However, the preferred embodiments are not intended to limit the present invention in scope.

For example, in each of the preferred embodiments of the present invention described above, the image heating device was provided with two rotationally movable members which are kept pressed upon each other. Further, one of the rotationally movable members was an endless film and the other was a roller. However, this setup is not intended to limit the present invention in scope. For example, the present invention is also applicable to an image heating device which employs a pair of endless belts suspended and stretched by multiple rollers, and which is structured so that the pair of belts are kept pressed upon each other by the rollers.

Also in each of the preferred embodiments described above, the image forming apparatus 100 had only one image heating-and-pressing device. However, the present invention is also applicable to an image forming apparatus having multiple image heating-and-pressing devices, for example, two image heating-and-pressing devices. In the case of an image forming apparatus having two image heating-and-pressing devices, it is possible to use one of them as an ordinary fixing device, and the other as a glossiness enhancement device. In such a case, the present invention is applicable to each of the image heating-and-pressing devices. The resultant effects of such application are the same as those obtained by the image heating devices in the preceding embodiments.

Also in each of the preferred embodiments described above, the image forming apparatuses had four image forming stations. However, this setup is not intended to limit the present invention in terms of the number of image forming stations with which an image forming apparatus is provided. That is, the applicability of the present invention to an image heating device has nothing to do with the number of the image forming stations of the image forming apparatus.

Not only is the present invention applicable to an image forming apparatus such as those in the preceding preferred embodiments of the present invention, but also a printer, a copying machine, a facsimile machine, etc., and a multifunction image forming apparatus capable of performing two or more functions of the preceding image forming apparatuses.

The measurements, materials, and shapes of the structural components of the image forming apparatus (image heating device), and the positional relationship among the structural components, in each of the preferred embodiments of the present invention described above, are not intended to limit the present invention in these attributes, unless specifically noted. That is, the present invention is applicable to image forming apparatuses which are different from those in the preferred embodiments, in terms of these attributes.

As will be evident from the description of the preferred embodiments of the present invention given above, the present invention can provide an image heating device which is superior to any of the image heating devices in accordance with the prior art, not only in that its heating performance is high enough to reliably yield a highly glossy image, but also, in that it can reliably separate a sheet of recording medium from the image heating rotational members of the image heating device, even if the sheet of recording medium is such a sheet of recording medium that is likely to remain wrapped around the rotational heating members of the image heating device.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 136540/2010 filed Jun. 15, 2010 which is hereby incorporated by reference.

What is claimed is:

1. A fixing apparatus comprising:

an endless belt configured to heat an unfixed toner image on a sheet at a nip portion in which the sheet is nipped and conveyed, said endless belt being disposed so as to contact the unfixed toner image on the sheet;

a rotatable member configured to form the nip portion cooperatively with said endless belt;

a pressing pad, provided inside said endless belt and configured to press said endless belt toward said rotatable member to form the nip portion;

a projection portion provided on a surface of said pressing pad opposed to said rotatable member and configured to apply a peak pressure in the nip portion;

a moving mechanism configured to move said pressing pad relative to said rotatable member in a sheet conveying direction; and a control portion configured to control an operation of said moving mechanism, wherein when a fixing operation for a thick sheet is performed, said projection portion is positioned within the nip portion and adjacent to an exit of the nip portion due to control by said control portion, and wherein when a fixing operation for a thin sheet having a thickness which is smaller than the thick sheet is performed, said projection portion is placed at a downstream position downstream and spaced from the exit of the nip portion in the sheet conveying direction due to control by said control portion.

2. The fixing apparatus according to claim 1, further comprising a heat source configured to heat said endless belt, wherein said moving mechanism moves said pressing pad integrally with said endless belt and said heat source relative to said rotatable member.

3. The fixing apparatus according to claim 2, wherein said heat source includes a coil configured to generate a magnetic flux for heating said endless belt by an electromagnetic induction.

4. The fixing apparatus according to claim 1, wherein a basis weight of the thick sheet is not less than 80 $g/m^2$, and a basis weight of the thin sheet is less than 80 $g/m^2$.

5. The fixing apparatus according to claim 1, wherein an average particle size of toner L μm, a density $\rho g/cm^3$ of the toner, an amount A $mg/cm^2$ of the toner in a solid portion of a monochromatic image satisfy, $$A<\rho\pi L/(30\sqrt{3}).$$

6. The fixing apparatus according to claim 1, wherein said rotatable member drives said endless belt to rotate by transmitting a rotational force through the nip portion.

* * * * *